US008666285B2

(12) United States Patent
Mizuno et al.

(10) Patent No.: US 8,666,285 B2
(45) Date of Patent: Mar. 4, 2014

(54) FIXING DEVICE AND IMAGE FORMING APPARATUS

(75) Inventors: Hiroshi Mizuno, Aisai (JP); Kuniya Matsuura, Toyohashi (JP); Takayuki Ito, Nagoya (JP); Masayuki Satou, Toyohashi (JP); Takashi Fujiwara, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 276 days.

(21) Appl. No.: 13/046,844

(22) Filed: Mar. 14, 2011

(65) Prior Publication Data

US 2011/0236070 A1 Sep. 29, 2011

(30) Foreign Application Priority Data

Mar. 23, 2010 (JP) ..... 2010-066128

(51) Int. Cl.
*G03G 15/16* (2006.01)
*G03G 15/20* (2006.01)

(52) U.S. Cl.
USPC ..... 399/122; 399/69; 399/320

(58) Field of Classification Search
USPC ..... 399/122, 67, 69, 320
See application file for complete search history.

(56) References Cited

U.S. PATENT DOCUMENTS

| | | | | |
|---|---|---|---|---|
| 5,561,512 | A | 10/1996 | Fukano et al. | |
| 5,732,309 | A * | 3/1998 | Okuno et al. | 399/320 X |
| 7,526,242 | B2 * | 4/2009 | Takagaki et al. | 399/307 |
| 2009/0052924 | A1 * | 2/2009 | Baek et al. | 399/67 |

FOREIGN PATENT DOCUMENTS

| | | | |
|---|---|---|---|
| CN | 1243972 | A | 2/2000 |
| JP | 8-190303 | A | 7/1996 |
| JP | 2003-241551 | A | 8/2003 |
| JP | 2004-012675 | A | 1/2004 |
| JP | 2006-133317 | A | 5/2006 |
| JP | 2006-133318 | * | 5/2006 |
| JP | 2006-133318 | A | 5/2006 |
| JP | 2006-308654 | A | 11/2006 |
| JP | 2008-145636 | A | 6/2008 |
| JP | 2009-186933 | A | 8/2009 |
| JP | 2010048987 | A | 3/2010 |
| JP | 2011-191706 | A | 9/2011 |

OTHER PUBLICATIONS

Office Action (Notice of Grounds of Rejection) dated Aug. 21, 2012, issued in corresponding Japanese Patent Application No. 2010-066128, and an English Translation thereof. (11 pages).

(Continued)

*Primary Examiner* — Sandra Brase
(74) *Attorney, Agent, or Firm* — Buchanan Ingersoll & Rooney PC

(57) ABSTRACT

A fixing device for fixing a toner image onto a recording paper sheet includes a heating member for heating the recording paper sheet, a pressing member for applying a pressure by forming contact with the heating member, a casing accommodating the heating member and the pressing member, and provided with an exit port for discharging the recording paper sheet, and a closing portion arranged at the exit port for keeping a temperature of the casing. The closing portion has a rotation member, and an opposed member forming a nip region together with the rotation member. A separating unit for changing at least a part of the closing portion from a closed state to an open state.

9 Claims, 25 Drawing Sheets

(56) References Cited

OTHER PUBLICATIONS

Japanese Office Action dated Nov. 20, 2012, with English-language translation.

Office Action issued on Jan. 22, 2013 by Chinese Patent Office in corresponding Chinese Patent Application No. 201110072595, and an English Translation thereof.

* cited by examiner

FIXING DEVICE AND IMAGE FORMING APPARATUS

This application is based on Japanese Patent Application No. 2010-066128 filed with the Japan Patent Office on Mar. 23, 2010, the entire content of which is hereby incorporated by reference.

BACKGROUND OF THE INVENTION

1. Field of the Invention

The present invention relates to an image forming apparatus, and particularly to a structure of a fixing device contained in the image forming apparatus.

2. Description of the Related Art

In an image forming apparatus of an electrophotographic type, a photosensitive drum is substantially uniformly charged, and then a laser scanning unit or the like conducts exposure on the photosensitive drum to form an electrostatic latent image according to an image signal. Then, toner that is charged by a developer is supplied onto the photosensitive drum to visualize a toner image, which is transferred onto a recording paper sheet such as a transfer paper sheet. The toner image transferred onto the recording paper sheet is merely born on the recording paper sheet, and is not fixed thereto. Therefore, a fixing unit arranged in the image forming apparatus applies heat and pressure for thermally welding and fixing it so that a fixed image is formed on the recording paper sheet.

In a basic structure of the conventional fixing device, a heating member containing a halogen lamp, a pressing member pressed against the heating member and a thermistor sensing a temperature of the heating member are arranged in a casing. In this fixing device, a toner image passing through a nip portion formed by pressing the heating member and the pressing member together is heated by heat of the heating member heated by radian heat of the halogen lamp, and receives a pressure caused by the heating member and the pressing member pressed together so that the toner image is fixed to a recording paper sheet. The casing is provided with an entry port for taking in the recording paper sheet and an exit port for discharging the recording paper sheet. The recording paper sheet bearing the toner image is taken into the casing through the entry port, and the recording paper sheet subjected to the fixing is discharged from the casing through the exit port.

A fixing device disclosed in Japanese Laid-Open Patent Publication No. 08-190303 is provided with a cooling device such as a fan for adjusting an inside temperature of the fixing device.

However, the structure provided with the fan does not allow reduction in size of the fixing device, and also suffers from a problem relating to efficient use of thermal energy that was used for heating the fixing device because the rotating fan forcedly cools a whole inside of the fixing device.

SUMMARY OF THE INVENTION

The invention has been made for overcoming the above problems, and an object of the invention is to provide a fixing device and an image forming apparatus that does not employ a fan and can efficiently use thermal energy.

A fixing device according to an aspect of the invention is a fixing device for fixing a toner image onto a recording paper sheet, and includes a heating member for heating the recording paper sheet; a pressing member for applying a pressure by forming contact with the heating member; a casing accommodating the heating member and the pressing member, and provided with an exit port for discharging the recording paper sheet; and a closing portion arranged at the exit port for keeping a temperature of the casing. The closing portion has a rotation member, and an opposed member forming a nip region together with the rotation member. The fixing device further includes a separating unit for changing at least a part of the closing portion from a closed state to an open state.

Preferably, the closing portion further includes an elastic member arranged on a side opposed to the opposed member with the rotation member therebetween for biasing the opposed member to press the opposed member against the rotation member, and the separating unit has a pressing member for pressing the opposed member, against a biasing force of the elastic member, in a direction separating the opposed member from the rotation member.

Particularly, the pressing member further has a contact piece being rotatable around a rotation axis and being in contact with the opposed member, and the opposed member is movably arranged to move away from the rotation member in accordance with the rotation of the contact piece around the rotation axis.

Particularly, the opposed member includes a first opposed portion, a second opposed portion neighboring to the first opposed portion and a third opposed portion opposed to the first opposed portion with the second opposed portion therebetween, and the pressing member separates at least a part of the second and third opposed portions from the rotation member.

Preferably, the separating unit further has a shape-memory material arranged on the side opposed to the rotation member with the first opposed portion therebetween for pressing the opposed member, against a biasing force of the elastic member, to separate the opposed member from the rotation member in accordance with a change in temperature.

Preferably, the fixing device further includes a temperature sensing unit for sensing a temperature inside the casing. The separating unit changes a state of at least a part of the closing portion from a closed state to an open state based on a result of sensing of the temperature sensing unit after an end of a print job.

Particularly, the separating unit changes the state of at least a part of the closing portion from the open state to the closed state based on a result of sensing of the temperature sensing unit after setting at least a part of the closing portion to the open state.

Particularly, the separating unit changes the state of the closing portion from the open state to the closed state after a predetermined period elapsed since at least a part of the closing portion is set to the open state.

Preferably, the separating unit changes the state of at least a part of the closing portion from the closed state to the open state during execution of a print job.

Preferably, the fixing device further includes a rotation drive unit for rotating the rotation member.

Particularly, a rotation direction of the rotation member is switchable, and the rotation drive unit changes the rotation direction of the rotation member.

Preferably, the fixing device further includes a cooling portion arranged in an upper portion of the casing.

Preferably, the separating unit changes a state of at least a part of the closing portion from the closed state to the open state according to a weight or a size of the recording paper sheet.

Preferably, the separating unit changes a state of at least a part of the closing portion from the closed state to the open state according to coverage information of contents to be printed on the recording paper sheet.

An image forming apparatus according to an aspect of the invention includes a fixing device for fixing a toner image onto a recording paper sheet. The fixing device includes a heating member for heating the recording paper sheet; a pressing member for applying a pressure by forming contact with the heating member; a casing accommodating the heating member and the pressing member, and provided with an exit port for discharging the recording paper sheet; and a closing portion arranged at the exit port for keeping a temperature of the casing. The closing portion has a rotation member, and an opposed member forming a nip region together with the rotation member. The fixing device further includes a separating unit for changing at least a part of the closing portion from a closed state to an open state.

A fixing device according to another aspect of the invention is a fixing device for fixing a toner image onto a recording paper sheet, and includes a heating member for heating the recording paper sheet; a pressing member for applying a pressure by forming contact with the heating member; a casing accommodating the heating member and the pressing member, and provided with an exit port for discharging the recording paper sheet; and a closing portion arranged at the exit port for keeping a temperature of the casing. The closing portion has a rotation member, and an opposed member forming a nip region together with the rotation member. The opposed member has first, second and third regions in a circumferential surface direction. The first region has an arc-shaped form, and forms a nip region along an entire length in a lengthwise direction of the rotation member. The second region is provided with a partial arc-shape portion for forming a nip region along a partial length in the lengthwise direction of the rotation member, having a first retracted portion for avoiding contact with the rotation member other than the partial arc-shape portion. The third region is provided with a second retracted portion avoiding contact with the rotation member along an entire length in a lengthwise direction of the rotation member.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

A first embodiment of the invention will be described below with reference to the drawings. In the following description, the same parts and components bear the same reference numbers and the same names, and achieve the same functions.

(First Embodiment)

Figure 1:
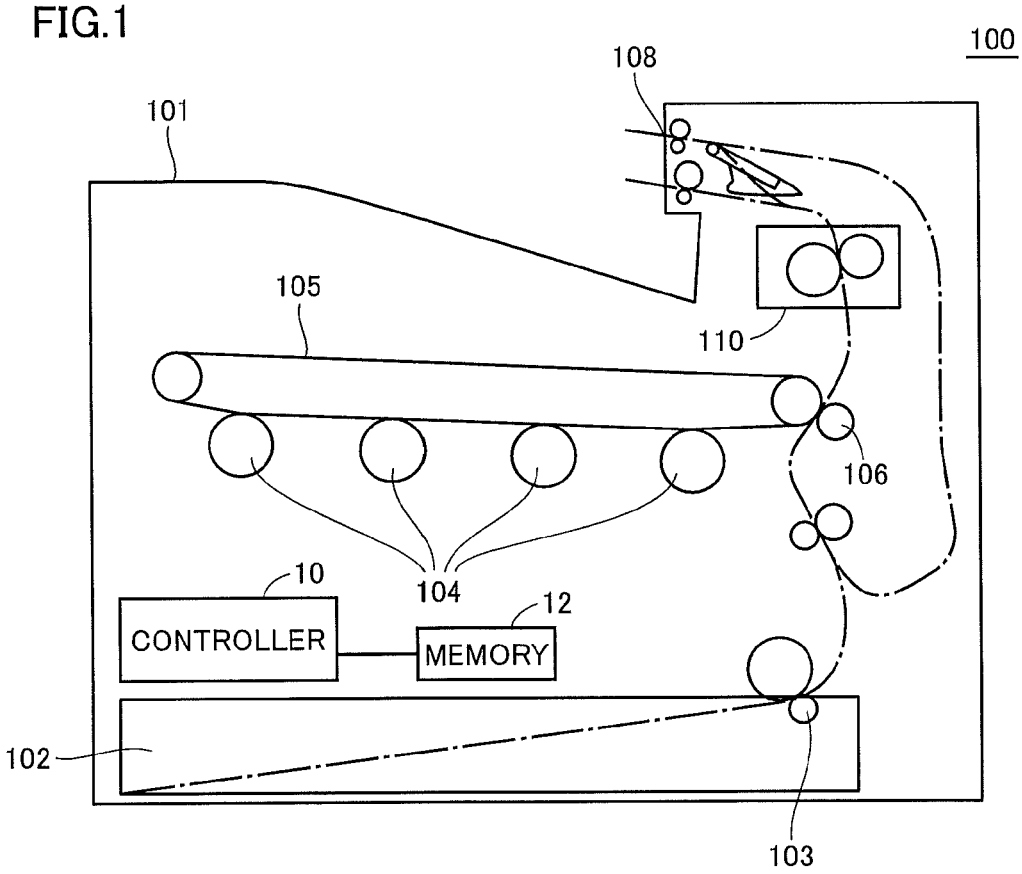
FIG. 1 illustrates a structure of an image forming apparatus according to a first embodiment of the invention.

FIG. 1 illustrates a structure of an image forming apparatus according to a first embodiment of the invention.

Referring to FIG. 1, an image forming apparatus 100 according to the first embodiment of the invention has an outer cover 101 covering a whole body of the apparatus, and a recording paper sheet subjected to printing inside the apparatus body is discharged from an exit port 108.

For example, the apparatus body in this embodiment is a color printer of a tandem type forming color images.

Specifically, the example includes, for image formation, four rotating photoreceptors 104, an intermediate transfer belt 105 that successively layers toner images formed successively in respective transfer positions on photoreceptors 104 and transfers them, and a transfer roller 106 arranged in a transfer position that is set around a transportation plane of intermediate transfer belt 105. A sheet feed roller 103 transports the recording paper sheets stored in a sheet cassette 102 to the transfer position.

Image forming apparatus 100 forms an electrostatic latent image on photoreceptor 104 based on image data to be printed on the recording paper sheet. The electrostatic latent images formed on photoreceptor 104 are visualized by development to form toner images, which are successively layered by intermediate transfer belt 105. The toner images that were electrostatically transferred onto intermediate transfer belt 105 and were combined together are electrostatically and collectively transferred onto the recording paper sheet in the transfer position by electrostatic attraction from transfer roller 106. The transfer paper sheet (recording paper sheet) subjected to the transfer passes through a fixing device 110 to fix the image by heat and pressure applied thereto. This step completes the image formation. Then, the recording paper sheet is discharged from exit port 108.

This embodiment employs a controller 10 for entirely controlling image forming apparatus 100. Controller 10 reads an application program stored in a memory 12, and thereby implements a flow to be described later.

Figure 2:
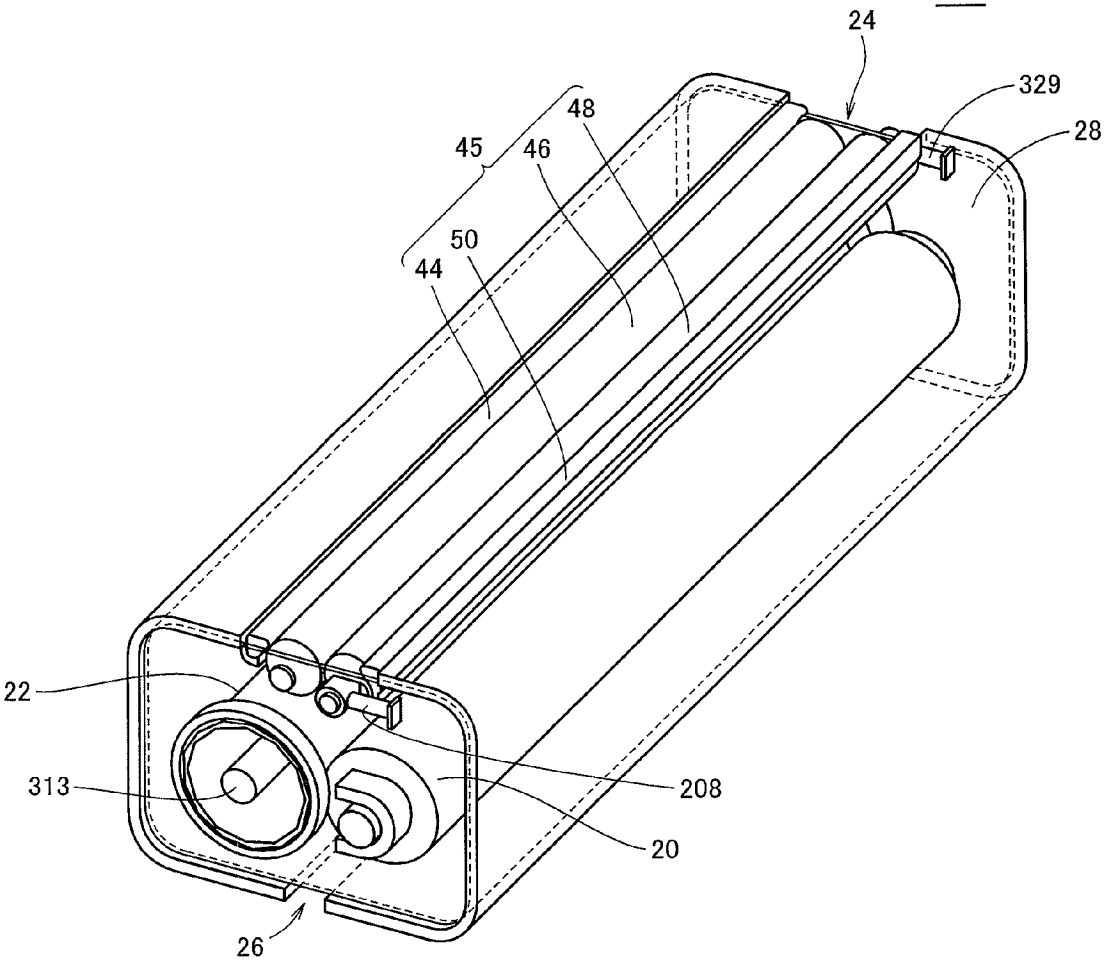
FIG. 2 is a perspective view of a fixing device according to a first embodiment of the invention.

FIG. 2 is a perspective view of fixing device 110 according to the first embodiment of the invention.

Referring to FIG. 2, fixing device 110 is substantially entirely covered by a casing 28, is provided at an upper side (downstream in the transporting direction of the document) of casing 28 with an exit port 24, and is provided at a lower portion on the opposite side (upstream in the transporting direction of the document) with an entry port 26.

Casing 28 is provided with a heating roller 22 containing a halogen lamp 313 as well as a pressing roller 20.

The recording paper sheet that is transported into entry port 26 in the lower portion of casing 28 is subjected to the heating and pressing by heating and pressing rollers 22 and 20 for fixing the toner image, and then is discharged from exit port 24.

The first embodiment of the invention employs a closing portion 45 added to exit port 24 for closing the exit port.

More specifically, closing portion 45 includes heat insulators 44 and 50 as well as heat-insulating rotation rollers 46 and 48. Heat-insulating rotation rollers 46 and 48 are pressed against each other to form a nip region. The nip region is formed such that a space may not be formed in a region other than the recording paper sheet when the recording paper sheet is passing therethrough.

Heat-insulating rotation rollers 46 and 48 rotate to discharge through exit port 24 the recording paper sheet bearing the toner image that is fixed by heating and pressing rollers 22 and 20.

Therefore, heat-insulating rotation rollers 46 and 48 form the nip region, and therefore can suppress external releasing of thermal energy through the exit port when the recording paper sheet is externally discharged according to the rotation of heat-insulating rotation rollers 46 and 48.

Thereby, the heat that was generated in the heating roller and was not used for melting the toner in the printing and non-printing operations can be prevented from being externally released from the casing of fixing device 110. Further, it is possible to promote the temperature rising in fixing device 110. This results in such effects that a warm-up time can be reduced, and temperature lowering of the heating roller can be restrained, so that improvement in energy efficiency can achieve energy saving as well as reduction in running cost.

In this structure, elastic members 208 and 329 are arranged between a bearing member of heat-insulating rotation roller 48 and casing 28. On one side, elastic members 208 and 329 are coupled to casing 28 and, on the other side, are coupled to heat-insulating rotation roller 48 for pressing it against heat-insulating rotation roller 46. The elastic members may be elastic rubber, elastic springs and the like.

Also, in the first embodiment of the invention, a separating unit for separating heat-insulating rotation rollers 46 and 48 forming closing portion 45 is employed as a cooling portion for cooling heating and pressing rollers 22 and 20.

Figure 3:
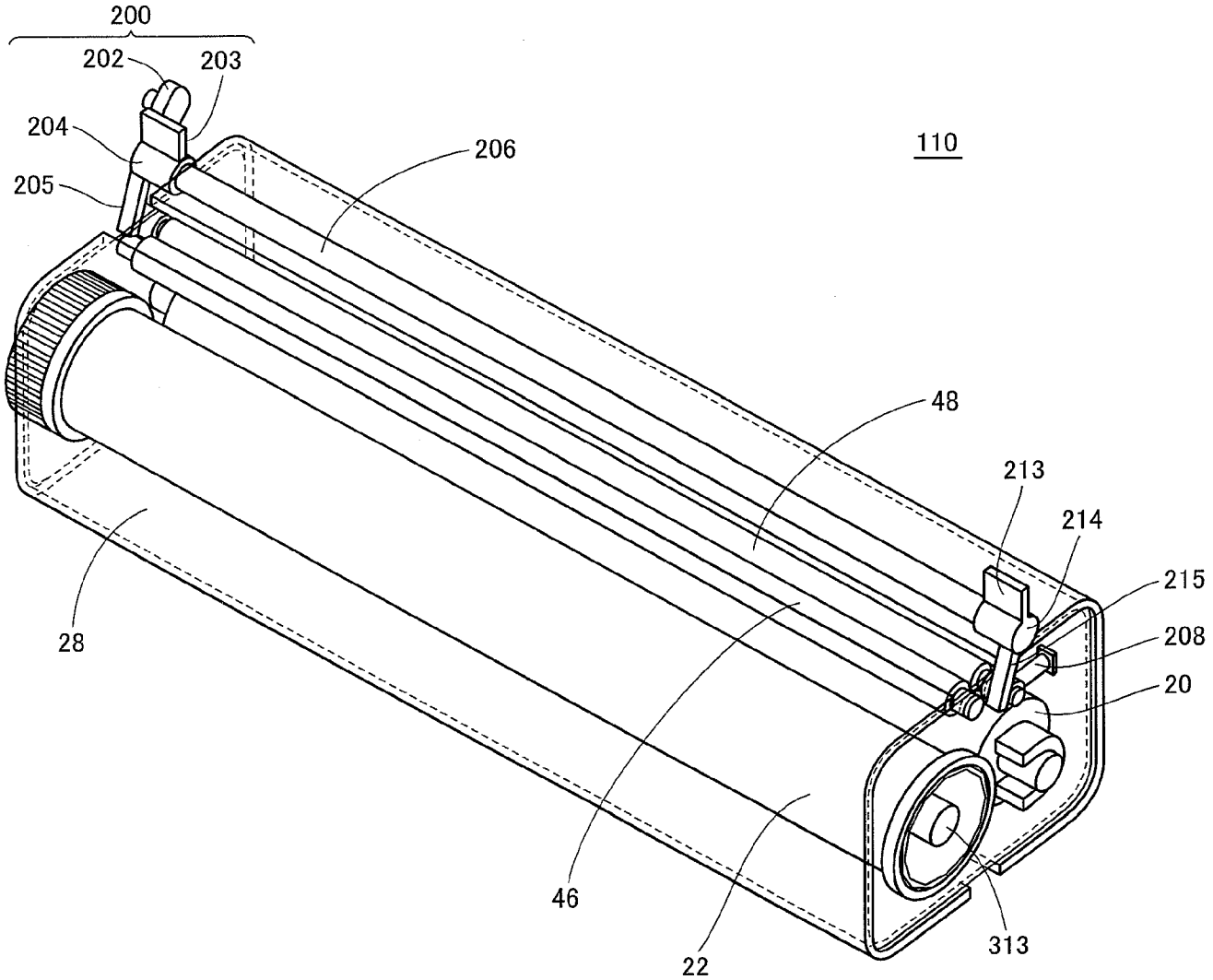
FIG. 3 is a perspective view provided with a separating unit according to the first embodiment of the invention.

Referring to FIG. 3, description will be given with respect to a perspective view of fixing device 110 provided with separating unit 200 according to the first embodiment.

Referring to FIG. 3, a rotation pressing member 202, a rotation shaft 206 and a rotation member that is pressed by rotation of rotation pressing member 202 are arranged as separating unit 200. On one end of rotation shaft 206, there is arranged a rotation member that is formed of a cylindrical portion 204 covering an end to rotation shaft 206, a contact piece 203 projecting from cylindrical portion 204 for contact with and pressing by rotation pressing member 202, and a pressing piece 205 projecting from cylindrical portion 204 oppositely to contact piece 203. On the other end of the rotation shaft, there is arranged a rotation member that is formed of a cylindrical portion 214 covering the end of rotation shaft 206, a contact piece 213 projecting from cylindrical portion 214 and a pressing piece 215 projecting from cylindrical portion 214 oppositely to contact piece 213. Pressing pieces 205 and 215 are in contact with bearing members of heat-insulating rotation roller 48. FIG. 3 shows a state in which rotation pressing member 202 is not pressing contact piece 203.

As described above, elastic members 208 and 329 are arranged between the respective bearing members of heat-insulating rotation roller 48 and casing 28, and elastic member 329 is arranged on one side of the bearing member of heat-insulating rotation roller 48. Elastic member 208 is arranged on the other side of the bearing member of heat-insulating rotation roller 48.

Figure 4:
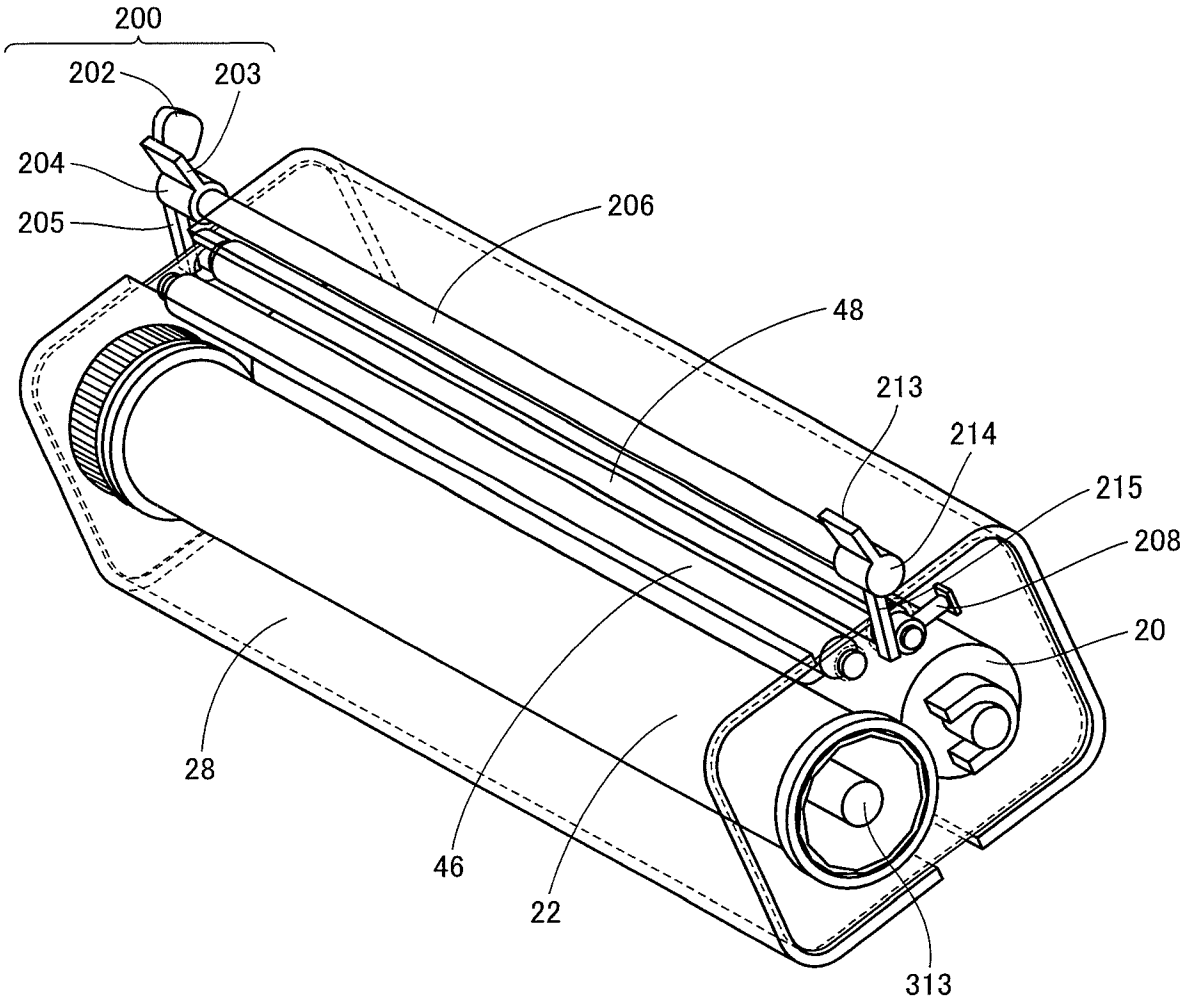
FIG. 4 is another perspective view of the fixing device provided with the separating unit according to the first embodiment of the invention.

Referring to FIG. 4, description will be given in connection with another perspective view of fixing device 110 provided with separating unit 200 according to the first embodiment of the invention.

Referring to FIG. 4, there is shown a state in which rotation pressing member 202 rotates so that rotation pressing member 202 comes into contact with contact piece 203 to press it. Specifically, rotation pressing member 202 presses contact piece 203 to rotate the rotation member arranged on the end of rotation shaft 206. Specifically, according to the rotation of the rotation member, it presses the bearing member of heat-insulating rotation roller 48 in contact with pressing piece 205, against the biasing force of elastic member 329, to separate heat-insulating rotation roller 48 from heat-insulating rotation roller 46. Likewise, rotation shaft 206 transmits the drive to the rotation member on the other side to rotate it. Specifically, pressing piece 215 rotates together with rotation shaft 206. Thereby, it presses the bearing member of heat-insulating rotation roller 48 in contact with pressing piece 215, against the biasing force of elastic member 208, to separate heat-insulating rotation roller 48 from heat-insulating rotation roller 46.

Owing to the above operations pressing the bearing members of heat-insulating rotation roller 48, heat-insulating rotation roller 48 carried by the bearing members moves together with the bearing members away from heat-insulating rotation roller 46. Thereby, the nip region is released, and a space occurs between heat-insulating rotation rollers 46 and 48.

Figure 5B:
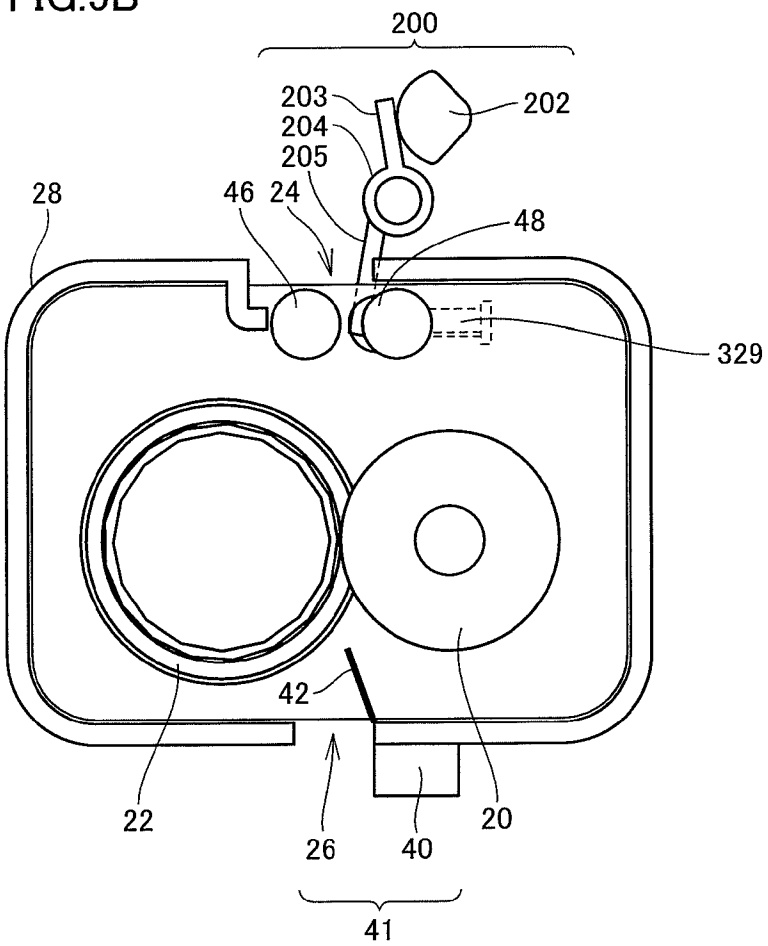
FIGS. 5A and 5B are cross sections of the fixing device according to the first embodiment of the invention.
Figure 5A:
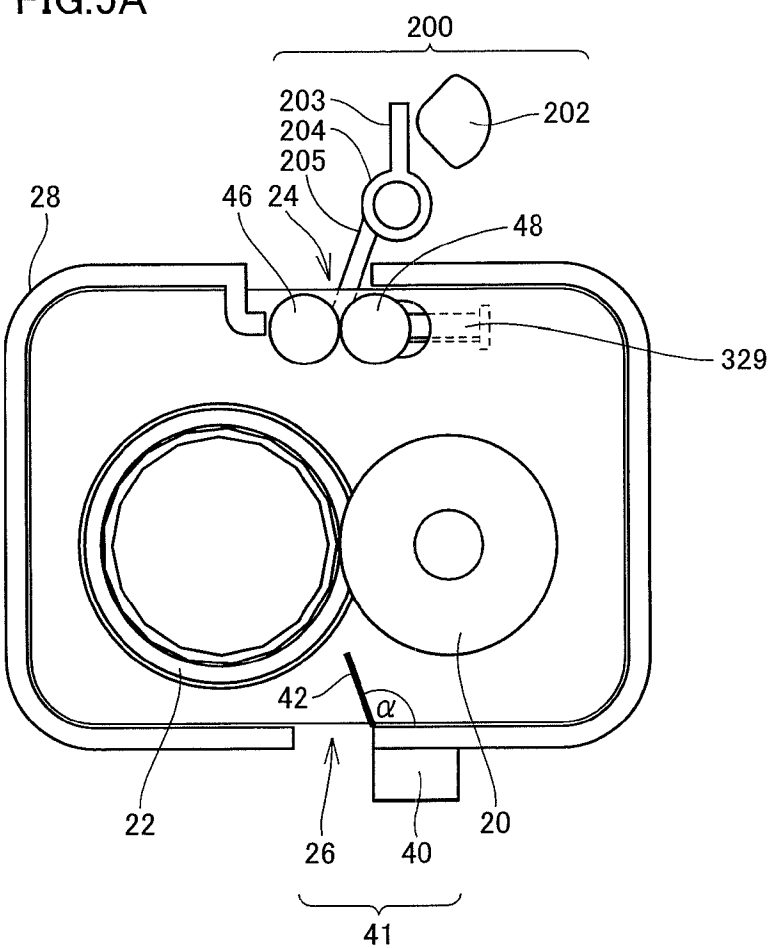

Referring to FIGS. 5A and 5B, description will be given in connection with cross sections of fixing device 110 according to the first embodiment of the invention.

Referring to FIG. 5A, there is shown a case in which rotation pressing member 202 is not pressing contact piece 203. A gear and a motor which are not shown in the figure can rotate rotation pressing member 202 to a predetermined angular position according to an instruction of controller 10.

Thus, in this contact state, elastic member 329 arranged between the bearing member of heat-insulating rotation roller 48 and casing 28 biases heat-insulating rotation roller 48 so that it is pressed against heat-insulating rotation roller 46. Thus, the nip region is formed and it is possible to suppress external releasing of the thermal energy through the exit port.

A closing portion 41 arranged in entry port 26 is also shown.

Closing portion 41 includes a shutter 42 that can open and close entry port 26 and a drive mechanism 40 driving shutter 42.

In a print operation drive mechanism 40 rotates shutter 42 from a position where it closes entry port 26 of the recording paper sheet to a position inside the casing. Specifically, shutter 42 rotates to form a predetermined angle $\alpha$ with respect to casing 28. Shutter 42 rotated by drive mechanism 40 to form predetermined angle $\alpha$ functions as a transport guide member that guides the recording paper sheet to the nip region between heating and pressing rollers 22 and 20.

In the state other than the printing, shutter 42 in the above structure closes entry port 26 so that it can enhance the heat retaining effect and thereby can further reduce the warm-up time.

Although not shown, a temperature sensing unit for sensing the temperature of heating roller 22 is employed. The on/off of the halogen lamp is controlled based on a result of the temperature sensing by the temperature sensing unit so that the temperature of heating roller 22 is adjusted. The temperature sensing unit is not particularly restricted, and may be either of the non-contact type or a contact type such as a thermistor.

Referring to FIG. 5B, there is shown a case in which rotation pressing member 202 is pressing contact piece 203. The gear and motor (not shown) rotates rotation pressing member 202 to a predetermined angle.

When rotation pressing member 202 presses contact piece 203 to rotate the rotation member arranged on the end of rotation shaft 206. According to the rotation of the rotation member, it presses the bearing member of heat-insulating rotation roller 48 in contact with pressing piece 205, against the biasing force of elastic member 329, to separate heat-insulating rotation roller 48 from heat-insulating rotation roller 46.

Although not shown, according to the rotation of the rotation member, it likewise presses the bearing member of heat-insulating rotation roller 48 in contact with pressing piece 215, against the biasing force of elastic member 208, to separate heat-insulating rotation roller 48 from heat-insulating rotation roller 46.

Owing to the above operations pressing the bearing members, heat-insulating rotation roller 48 carried by the bearing members moves together with the bearing members away from heat-insulating rotation roller 46. Thereby, the nip region is released, and a space occurs between heat-insulating rotation rollers 46 and 48, and the heat can be externally discharged through the exit port.

Thus, owing to provision of separating unit 200 described above, it is possible to release the nip region formed between heat-insulating rotation rollers 46 and 48, and to form a space. Thereby, a fan can be eliminated, and heating and pressing rollers 22 and 20 in fixing device 110 can be cooled owing to provision of the space by separating unit 200. When necessary, closing portion 45 can close the exit port so that the thermal energy can be efficiently used.

Figure 6:
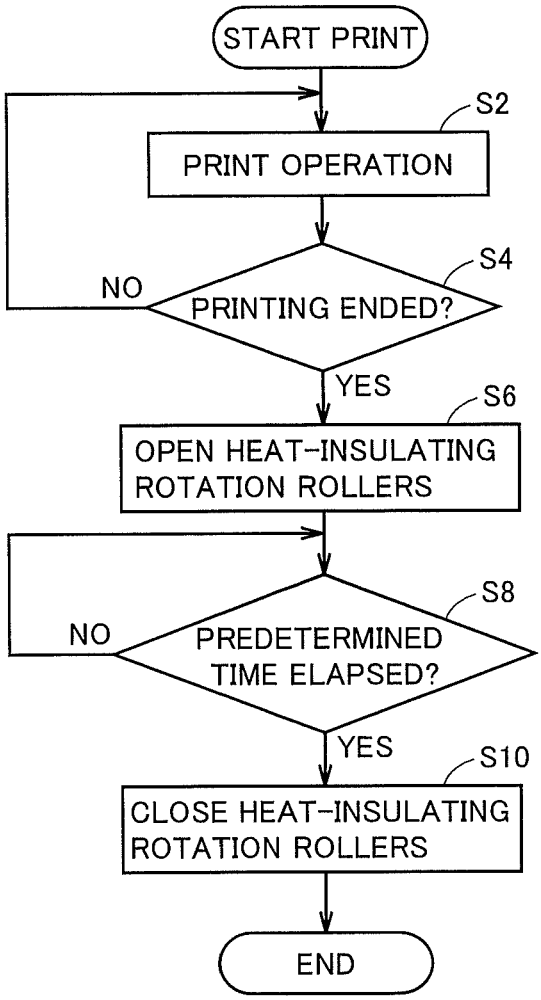
FIG. 6 is a flowchart illustrating a drive sequence of the separating unit according to the first embodiment of the invention.

Referring to FIG. 6, description will be given on the drive sequence of the separating unit according to the first embodiment of the invention.

This drive sequence is implemented by controller 10 reading a software program stored in memory 12.

Referring to FIG. 6, controller 10 first executes a printing operation according to a print start instruction (step S2). Specifically, an electrostatic latent images are formed on a photoreceptor 104 based on image data to be printed on the recording paper sheet in accordance with input of a print command. The electrostatic latent images formed on photoreceptor 104 are visualized by development and are successively layered on intermediate transfer belt 105. The toner images that are electrostatically transferred onto intermediate transfer belt 105 and are combined together are electrostatically and collectively transferred onto the recording paper sheet in a transfer position by electrostatic attraction by transfer roller 106. The transfer paper sheet (recording paper sheet) subjected to the transfer then passes through fixing device 110 to fix the image by the heat and pressure applied thereto. This step completes the image formation. Then, the recording paper sheet is discharged from exit port 108.

Controller 10 then determines whether the printing has ended or not (step S4).

When it is determined in step S4 that the printing has ended, controller 10 then releases the heat-insulating rotation rollers (step S6).

Specifically, controller 10 instructs the gear and motor (not shown) to set rotation pressing member 202 at a predetermined angle (FIG. 5B). Thus, rotation pressing member 202 presses contact piece 203 to rotate the rotation member arranged at the end of rotation shaft 206. According to the rotation of the rotation member, it presses the bearing member of heat-insulating rotation roller 48 in contact with pressing piece 205, against the biasing force of elastic member (329) 208, to separate heat-insulating rotation roller 48 from heat-insulating rotation roller 46 so that a space is formed between heat-insulating rotation rollers 46 and 48. Thereby, the heat can be externally released from fixing device 110 by a simply manner without employing a fan.

Then, controller 10 determines whether a predetermined period has elapsed or not (step S8). When the predetermined period has not elapsed (NO in step S8), the current state is maintained.

When it is determined in step S8 that the predetermined period has elapsed (YES in step S8), the heat-insulating rotation rollers are closed (step S10). Specifically, controller 10 instructs the gear and motor (not shown) to rotate further rotation pressing member 202. Thus, it rotates rotation pressing member 202 so that rotation pressing member 202 may occupy a position where it does not press contact piece 203 (FIG. 5A). This rotation releases the pressure applied to contact piece 203 by rotation pressing member 202 so that heat-insulating rotation roller 48 biased by elastic member 329 (208) moves in the direction that allows pressing against heat-insulating rotation roller 46.

Therefore, closing portion 45 can close the exit port again so that the temperature inside fixing device 110 rises again, which can improve the heat retaining effect and allows efficient use of the thermal energy.

(First Modification)

A system according to a first modification of the first embodiment of the invention will be described below in connection with a system for finely adjusting the temperature inside fixing device 110.

Figure 7:
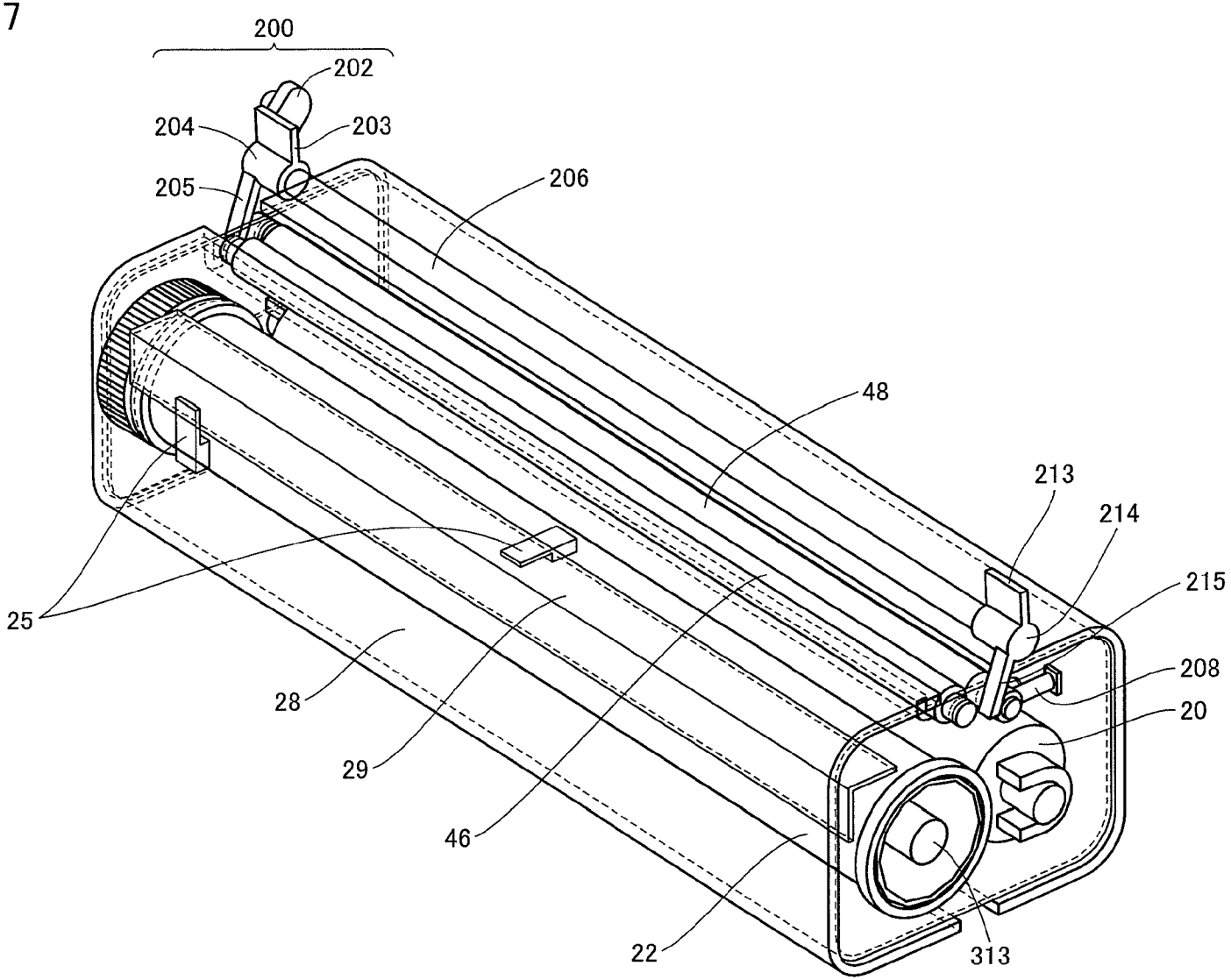
FIG. 7 is a perspective view of the fixing device provided with the separating unit and a thermistor according to a first modification of the first embodiment of the invention.

Referring to FIG. 7, description will be given in connection with a perspective view in which fixing device 110 is provided with separating unit 200 and a thermistor according to the first modification of the first embodiment of the invention.

FIG. 7 shows a case in which the thermistor is added to the structures illustrated in FIG. 3. Specifically, an attachment member 29 is arranged in casing 28 and is attached to the inner wall of casing 28. Two thermistors 25 for sensing the temperature of heating roller 22 are arranged on attachment member 29. Thermistor 25 is arranged on each of the central portion and the end portion of heating roller 22. The thermistor may be one in total number. The temperature of heating roller 22 is adjusted based on the result of temperature sensing by thermistor 25. Thermistor 25 provides the result of temperature sensing to controller 10.

In the foregoing flow diagram of FIG. 6, description has been given on the case where separating unit 200 separates heat-insulating rotation rollers 46 and 48 from each other to form a space therebetween when the printing ends. However, when the temperature of heating roller 22 is not abnormal, it may be desirable to keep a closed state.

Figure 8:
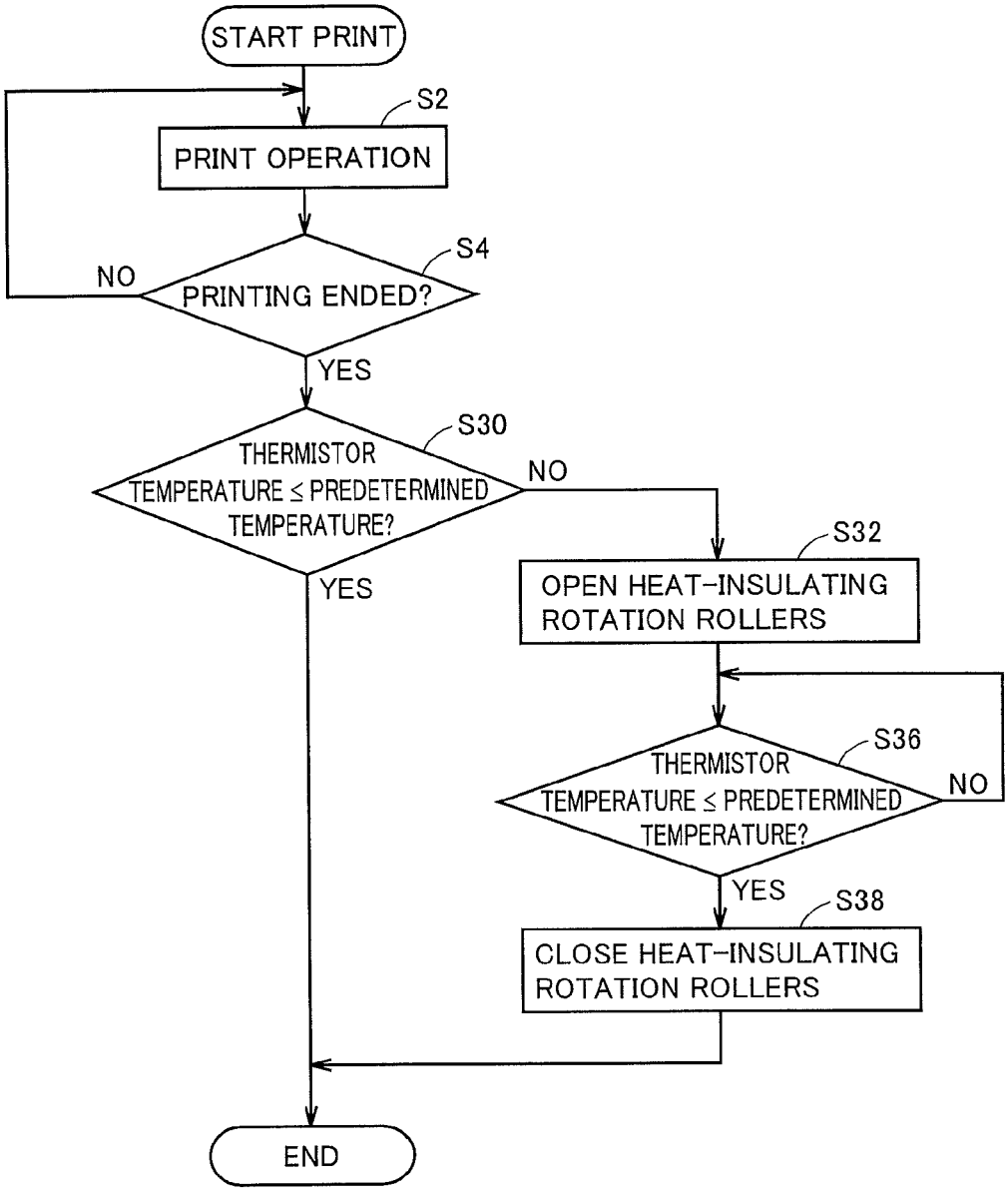
FIG. 8 is a flowchart illustrating a drive sequence of the separating unit according to the first modification of the first embodiment of the invention.

Referring to FIG. 8, description will be given on a drive sequence of the separating unit according to the first modification of the first embodiment of the invention.

This drive sequence is implemented by controller 10 reading a software program stored in memory 12.

Referring to FIG. 8, controller 10 executes the print operation according to the print start instruction as described before (step S2).

Then, controller 10 determines whether the printing has ended or not (step S4).

When it is determined that the printing has ended, it is then determined whether the temperature of thermistor is equal to or lower than a predetermined temperature nor not (step S30).

When it is determined that the temperature of thermistor 25 is equal to or lower than the predetermined temperature, the processing ends (END).

Conversely, when it is determined that the temperature of thermistor 25 is not equal to or lower than the predetermined temperature, i.e., it exceeds the predetermined temperature (NO in step S30), controller 10 releases the heat-insulating rotation roller (step S32).

Then, controller 10 determines whether the temperature of thermistor is equal to or lower than the predetermined temperature or not (step S36). When it is determined that the temperature of thermistor is equal to or lower than the predetermined temperature (YES in step S36), the heat-insulating rotation rollers are closed (step S38).

When it is determined that the temperature of thermistor exceeds a predetermined temperature (NO in step S36), the current state is kept. Thus, the open state is kept.

Therefore, when it is determined, after the printing, based on the temperature sensing result of thermistor 25 that the temperature exceeds the predetermined temperature, the closed state changes to the open state. When heating roller 22 attains the predetermined temperature, closing portion 45 closes the exit port to allow minute adjustment of the temperature of fixing device 110, which allows efficient use of the thermal energy.

The example has been described in connection with the structure that employs thermistor 25 for sensing the temperature of heating roller 22. However, the system may be configured to sense the inside temperature of fixing device 110 instead of heating roller 22, and to control separating unit 200 in a similar manner.

(Second Modification)

Another drive sequence may be employed to execute the opening and closing of the heat-insulating rotation rollers not after the end of the printing but during the print operation (during the job execution). This example employs fixing device 110 provided with the thermistor according to the first modification of the first embodiment of the invention.

Figure 9:
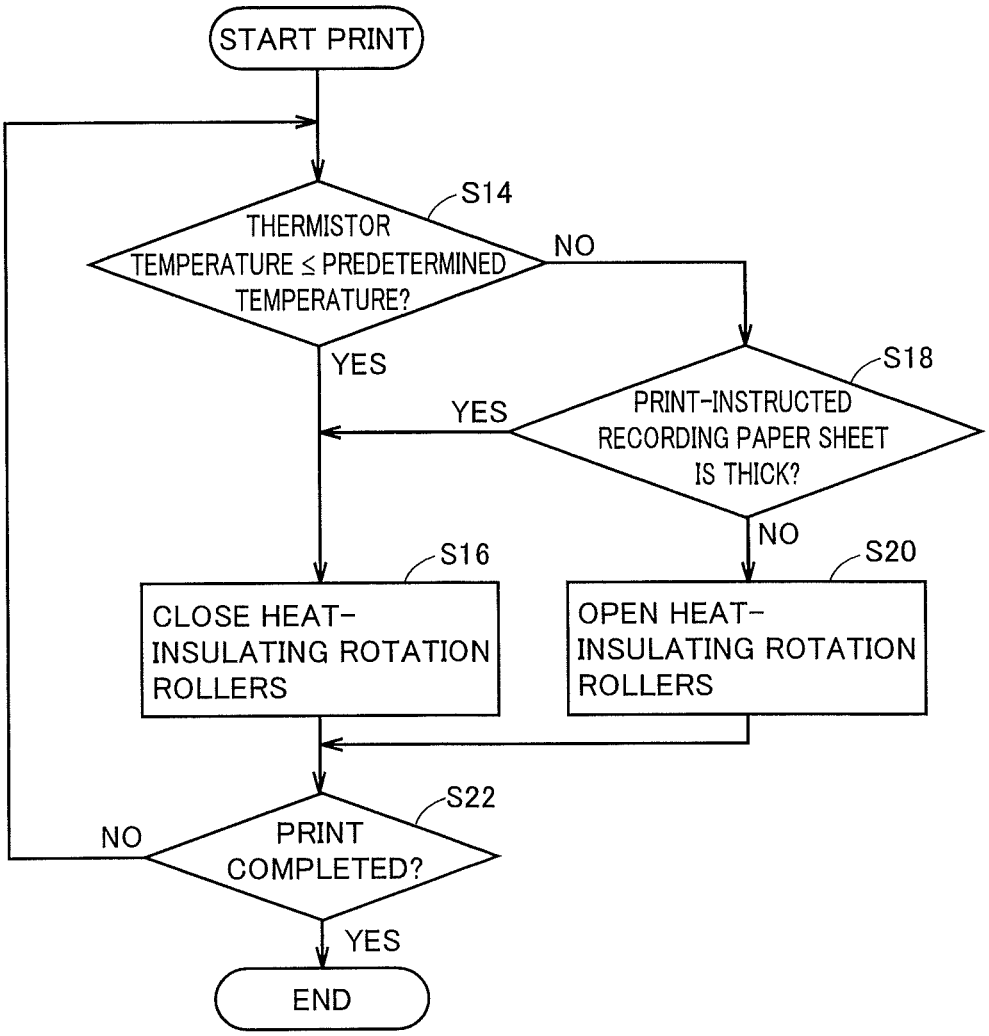
FIG. 9 is a flowchart illustrating a drive sequence of a separating unit according to a second modification of the first embodiment of the invention.

Referring to FIG. 9, description will be given on the drive sequence of the separating unit according to a second modification of the first embodiment of the invention.

This drive sequence is implemented by controller 10 reading a software program stored in memory 12.

Referring to FIG. 9, controller 10 starts the foregoing print operation according to the print start instruction as described before.

First, it is determined whether the temperature of thermistor 25 is equal to or lower than a predetermined temperature or not (step S14).

When it is determined that the temperature of thermistor 25 is equal to, or lower than the predetermined temperature (YES in step S14), the heat-insulating rotation rollers are closed (step S16). Then, it is determined whether the printing has ended or not (step S22).

When it is determined in step S22 that the printing is completed (YES in step S22), the processing ends (END). When it is determined in step S22 that the printing is not completed (NO in step S22), the process returns to step S14, and the processing will be repeated until completion of the printing.

When it is determined that the temperature of thermistor 25 is not equal to or lower than the predetermined temperature, i.e., it exceeds the predetermined temperature (NO in step S14), it is then determined whether the print instruction relates to a thick sheet of the recording paper sheet or not (step S18). Specifically, it is determined whether the foregoing instruction entered through an operation panel or the print setting of the received print job instructs the printing on the thick recording paper sheet or not.

When it is determined in step S18 that the printing on the thick recording paper sheet is instructed (YES in step S18), the heat-insulating rotation rollers are set to the closed state (step S16). Then, it is determined whether the printing is completed or not (step S22).

When it is determined in step S22 that the printing is completed (YES in step S22), the processing ends (END).

When it is determined in step S18 that the instruction does not relate to the printing on the thick recording paper sheet but relates to the printing on the recording paper sheet other than the thick sheet (NO in step S18), the heat-insulating rotation rollers are set to the open state (step S20). It is then determined whether the printing is completed or not (step S22).

When it is determined in step S22 that the printing is completed (YES in step S22), the processing ends (END).

The flowchart of FIG. 6 may be employed for combination for setting the heat-insulating rotation rollers to the open state after the end of the printing.

In the first modification already described, when it is determined that the temperature of thermistor 25 is not equal to or lower than the predetermined temperature, i.e., it exceeds the predetermined temperature, the heat-insulating rotation rollers are set to the open state. However, the quantity of heat taken into the thick recording paper sheet in the fixing step for the thick recording paper sheet is larger than the quantity of heat taken into the recording paper sheet other than the thick sheet in the fixing step for the recording paper sheet other than the thick sheet. Therefore, it is necessary in the fixing step for the thick recording paper sheet to heat sufficiently fixing device 110.

In this example, therefore, when the print instruction is issued for the thick recording paper sheet, the heat-insulating rotation rollers are set to the closed state to raise the temperature inside fixing device 110 so that the heat retaining effect can be improved and the thermal energy can be efficiently used.

When the print instruction was issued for the recording paper sheet other than the thick sheet, the heat-insulating rotation rollers are set to the open state so that the control can be performed to prevent excessive rising of the temperature inside fixing device 110. Therefore, the print operation can continue without stopping the operation.

For example, when different recording paper sheets (a front cover and main pages) are printed during a job according to the print setting in the received print job, the heat-insulating rotation rollers can be appropriately set to the open or closed state in accordance with the recording paper sheets.

This modification has been described in connection with the system that controls the separating unit according to the thickness (weight) of the recording paper sheet. However, it is naturally possible to control the separating unit according to the size of the recording paper sheet.

(Third Modification)

Figure 10:
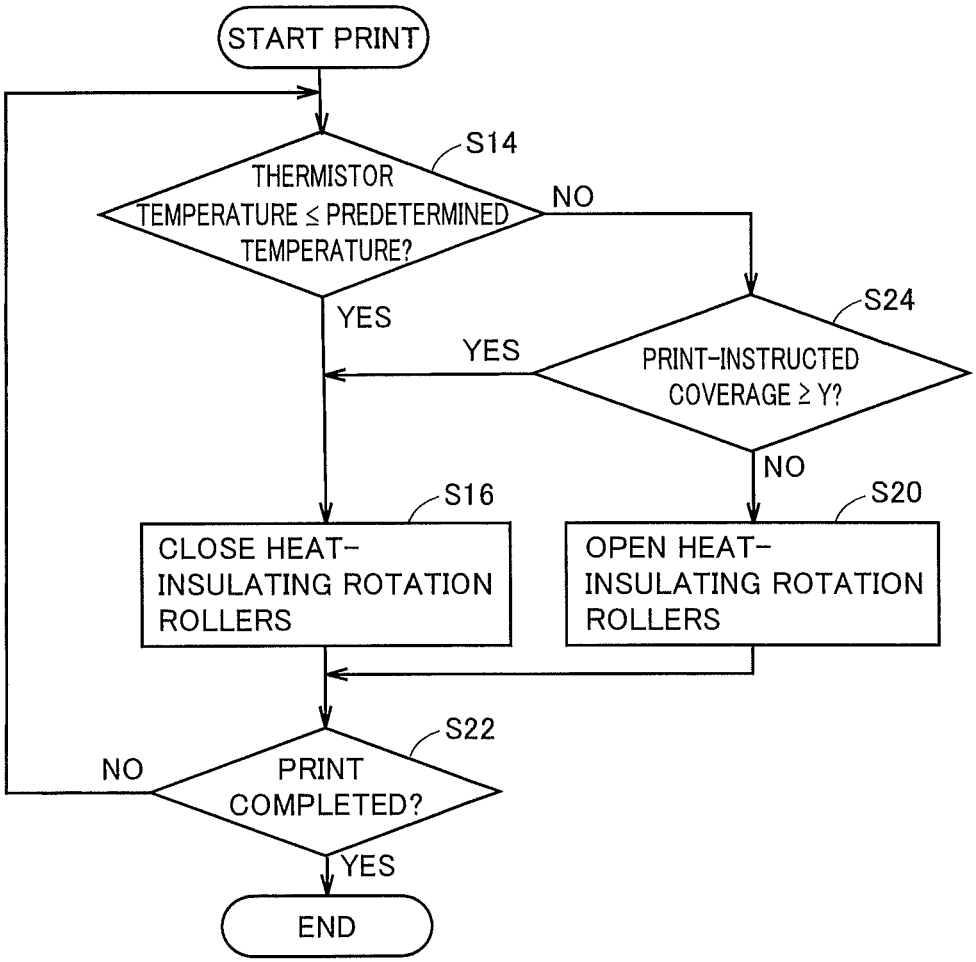
FIG. 10 is a flowchart illustrating a drive sequence of a separating unit according to a third modification of the first embodiment of the invention.

Referring to FIG. 10, description will be given on the drive sequence of the separating unit according to a third modification of the first embodiment of the invention.

This drive sequence is implemented by controller 10 reading a software program stored in memory 12. This example employs fixing device 110 provided with the thermistor according to the first modification of the first embodiment of the invention.

Referring to FIG. 10, controller 10 first starts the foregoing printing according to the print start instruction.

First, it is determined whether the temperature of thermistor 25 is equal to or lower than a predetermined temperature or not (step S14).

When it is determined that the temperature of thermistor 25 is equal to or lower than the predetermined temperature (YES in step S14), the heat-insulating rotation rollers are closed (step S16). It is determined whether the printing is completed or not (step S22).

When it is determined in step S22 that the printing is completed (YES in step S22), the processing ends (END). When it is determined in step S22 that the printing is not completed (NO in step S22), the process returns to step S14, and the processing will be repeated until the completion of printing.

When it is determined that the temperature of thermistor 25 is not equal to or lower than the predetermined temperature, i.e., it exceeds the predetermined temperature (NO in step S14), it is then determined whether the print instruction relates to a coverage equal to or larger than a coverage Y or not (step S24). Specifically, the coverage indicates a rate of a solid-painted region in an image that is obtained by scanning (image-reading) a document sheet. When the solid-painted region is large, the coverage value is high.

When it is determined in step S24 that the print instruction relates to the coverage equal to or larger than coverage Y (YES in step S24), the heat-insulating rotation rollers are set to the closed state (step S16). It is then determined whether the printing is completed or not (step S22).

When it is determined in step S22 that the printing is completed (YES in step S22), the processing ends (END).

When it is determined in step S24 that the print instruction relates to the coverage smaller than coverage Y (NO in step S24), the heat-insulating rotation rollers are set to the open state (step S20). It is then determined whether the printing is completed or not (step S22).

When it is determined in step S22 that the printing is completed (YES in step S22), the processing ends (END).

The flowchart of FIG. 6 may be employed for combination for setting the heat-insulating rotation rollers to the open state after the end of the printing.

When it is determined that the temperature of thermistor 25 is not equal to or lower than the predetermined temperature, i.e., it exceeds the predetermined temperature, the heat-insulating rotation rollers are set to the open state in the first modification already described. However, the quantity of heat taken into the recording paper sheet of the large coverage in the fixing step is larger than the quantity of heat taken into the recording paper sheet of the small coverage in the fixing step because there is a difference in quantity of the fixed toner. Therefore, it is necessary in the fixing step for the recording paper sheet of the large coverage value to heat sufficiently fixing device 110.

In this example, therefore, when the print instruction is issued for the recording paper sheet of the large coverage, the heat-insulating rotation rollers are set to the closed state to raise the temperature inside fixing device 110 so that the heat retaining effect can be improved and the thermal energy can be efficiently used.

When the print instruction was issued for the recording paper sheet of the small coverage value, the heat-insulating rotation rollers are set to the open state so that the control can be performed to prevent excessive rising of the temperature inside fixing device 110.

For example, when respective pages have different coverages, respectively, the heat-insulating rotation rollers can be appropriately set to the open or closed state in accordance with the coverage.

(Second Embodiment)

A second embodiment will be described below in connection with a structure of a separating unit that is different from that in the first embodiment.

Figure 11:
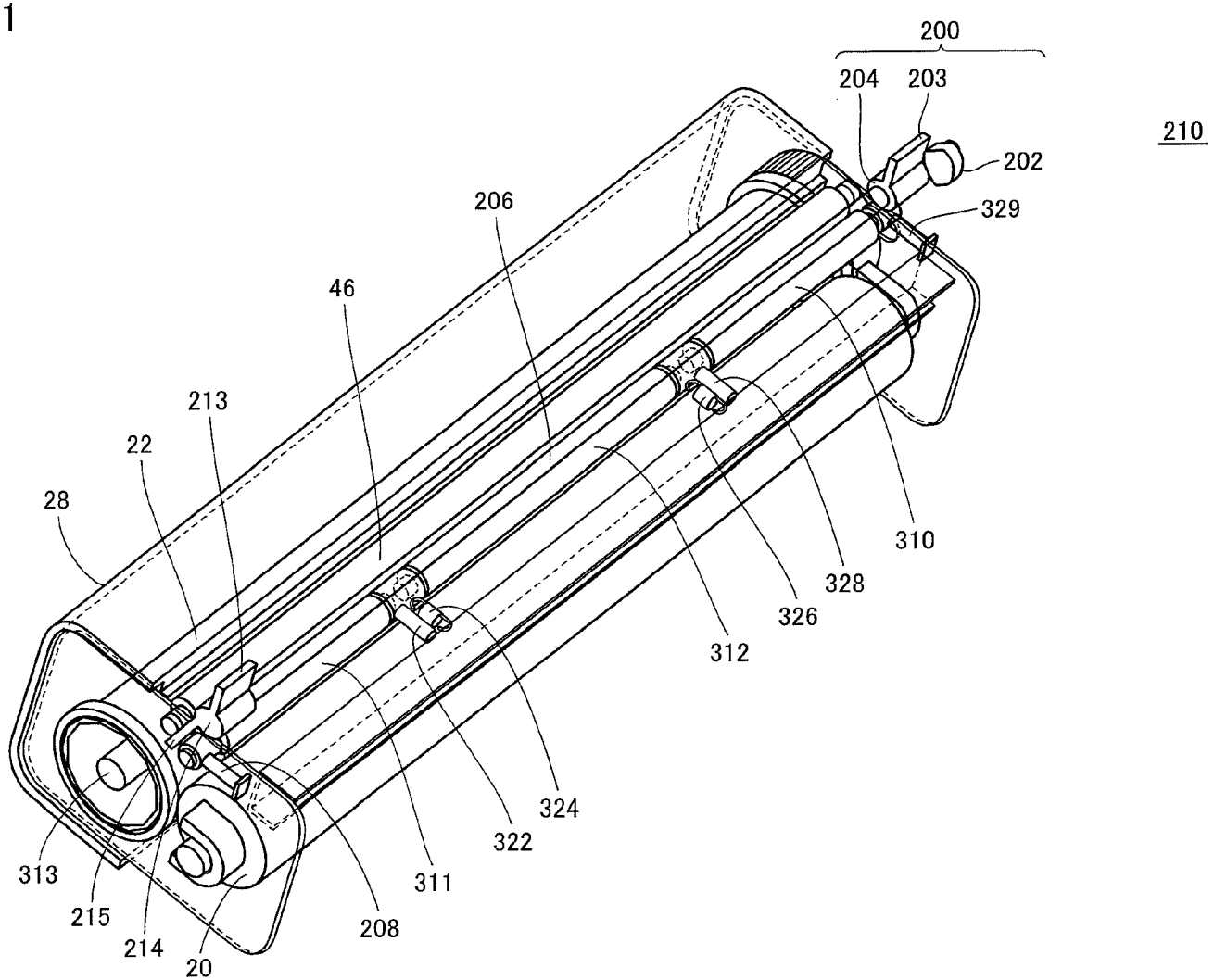
FIG. 11 is a perspective view of a fixing device provided with a separating unit according to a second embodiment of the invention.

Referring to FIG. 11, description will be given with respect to a perspective view of a fixing device 210 provided with separating unit 200 according to the second embodiment.

Referring to FIG. 11, fixing device 210 according to the second embodiment of the invention differs in structure of heat-insulating rotation roller 48 from that in the first embodiment.

Specifically, heat-insulating rotation roller 48 is replaced with heat-insulating rotation roller units 312 and 311 neighboring to each other, and a heat-insulating rotation roller unit 310 opposed to heat-insulating rotation roller unit 312 with heat-insulating rotation roller unit 311 therebetween. Each heat-insulating rotation roller unit can operate independently of the others. Elastic members 322 and 328 carry the opposite ends of heat-insulating rotation roller unit 312, respectively, and biases heat-insulating rotation roller unit 312 to press elastically them against heat-insulating rotation roller 46. Shape-memory materials 324 and 326 each having a spring-like original shape are arranged along elastic members 322 and 328, and are arranged between heat-insulating rotation roller unit 312 and the casing. These shape-memory materials 324 and 326 are located to apply the biasing force that pulls heat-insulating rotation roller unit 312 away from heat-insulating rotation roller 46. In a normal-temperature state, however, shape-memory materials 324 and 326 are extended by the elastic biasing force applied by elastic members 322 and 328. Therefore, heat-insulating rotation roller unit 312 is in the state where it is pressed against heat-insulating rotation roller 46.

Elastic members 208 and 322 carry the ends of heat-insulating rotation roller unit 311, respectively. Elastic member 208 is arranged on one end of heat-insulating rotation roller unit 311 so that it presses heat-insulating rotation roller unit 311 against heat-insulating rotation roller 46. Elastic member 322 biases the other end of heat-insulating rotation roller unit 311 so that it presses heat-insulating rotation roller unit 311 against heat-insulating rotation roller 46.

Elastic members 328 and 329 carry the ends of heat-insulating rotation roller unit 310, respectively. Elastic member 329 is arranged on one end of heat-insulating rotation roller unit 310 so that it presses heat-insulating rotation roller unit 310 against heat-insulating rotation roller 46. Elastic member 328 biases the other end of heat-insulating rotation roller unit 310 so that it presses heat-insulating rotation roller unit 310 against heat-insulating rotation roller 46.

The structure of separating unit 200 is substantially the same as that in the first embodiment. Rotation pressing member 202 is in the state where it does not press contact piece 203.

In this structure, an operation similar to that already described in connection with rotation pressing member 202 with reference to FIG. 4 is performed.

Figure 12:
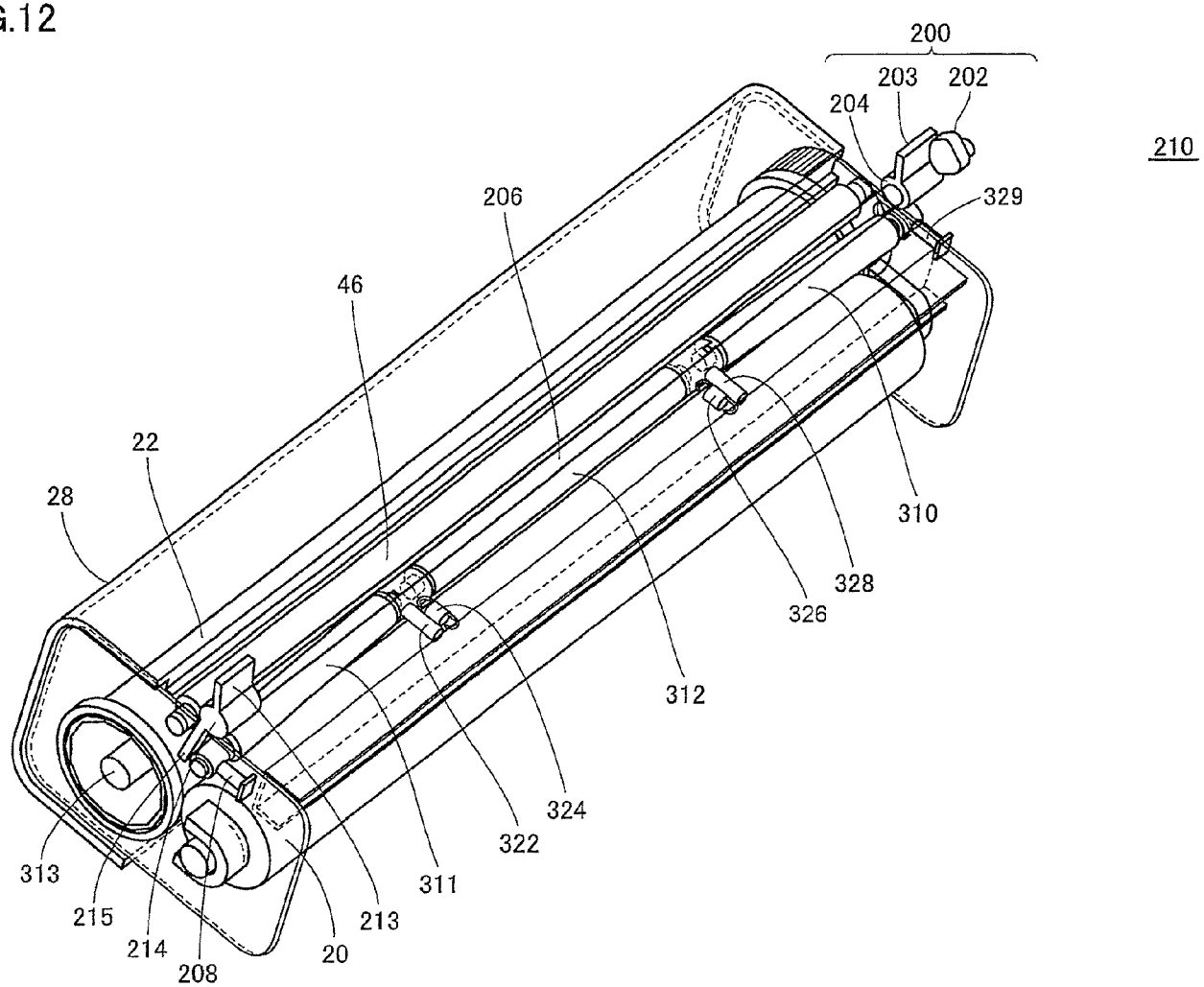
FIG. 12 is a perspective view showing another state of the fixing device provided with the separating unit according to the second embodiment of the invention.

Referring to FIG. 12, description will be given with respect to a perspective view showing another state of fixing device 210 provided with separating unit 200 according to the second embodiment of the invention.

Referring to FIG. 12, there is shown a state in which rotation pressing member 202 rotates so that it comes into contact with contact piece 203 and presses it. Specifically, rotation pressing member 202 presses contact piece 203 so that the rotation member arranged on the end of rotation shaft 206 rotates. According to the rotation of the rotation member, it presses the bearing member on one end of heat-insulating rotation roller unit 310 in contact with pressing piece 205, against the biasing force of elastic member 329, to separate the one end of heat-insulating rotation roller unit 310 from heat-insulating rotation roller 46. The other end of heat-insulating rotation roller unit 310 is arranged such that elastic member 328 biases heat-insulating rotation roller unit 310 to press it against heat-insulating rotation roller 46. Owing to this operation, only one end of heat-insulating rotation roller unit 310 is spaced from heat-insulating rotation roller 46 to a large extent.

The rotation member arranged on the end of rotation shaft 206 likewise rotates according to the rotation of rotation shaft 206. Thus, according to the rotation of the rotation member, it presses the bearing member on the end of heat-insulating rotation roller unit 311 in contact with pressing piece 215, against the biasing force of elastic member 208, to separate the end of heat-insulating rotation roller unit 311 from heat-insulating rotation roller 46. The other end of heat-insulating rotation roller unit 311 is arranged such that elastic member 322 biases heat-insulating rotation roller unit 311 to press it against heat-insulating rotation roller 46. Owing to this operation, only one end of heat-insulating rotation roller unit 311 is spaced from heat-insulating rotation roller 46 to a large extent.

This example has been described in connection with the structure in which pressing pieces 205 and 215 move the ends of heat-insulating rotation roller units 310 and 311 away from heat-insulating rotation roller 46, respectively. However, such a structure may be employed that pressing pieces 205 and 215 act to move the whole heat-insulating rotation roller units 310 and 311 away from heat-insulating rotation roller 46.

Heat-insulating rotation roller 48 has the structure formed of three parts, i.e., heat-insulating rotation roller units 310, 311 and 312, and the employment of this structure can move heat-insulating rotation roller units 311 and 310 with heat-insulating rotation roller unit 312 interposed therebetween away from heat-insulating rotation roller 46.

Owing to this structure, only a partial region can be separated from heat-insulating rotation roller 46 in contrast to heat-insulating rotation roller 48 already described in connection with the first embodiment in which separating unit 200 separates all the region thereof from heat-insulating rotation roller 46. Thus, spaces can be formed in the opposite end regions other than the central region, in the longitudinal direction, of heat-insulating rotation roller 46.

In general, the longitudinal length and the like of heating roller 22 in the fixing device are designed in view of the maximum size of the recording paper sheet to be passed over it. In many cases, the device is designed to pass the recording paper sheets over the central portion of heating roller 22. Therefore, when the recording paper sheets of a small size are passed continuously, the recording paper sheets take away the heat from the longitudinally central portion of heating roller 22. However, the heat is not taken away from the ends so that the temperature may rise at the ends of heating roller 22.

Accordingly, the above structure separates heat-insulating rotation roller units 310 and 311 that are the regions corresponding to the longitudinal ends of heating roller 22 from heat-insulating rotation roller 46 when the temperature of these ends rises. Thereby, spaces are formed in the regions corresponding to the longitudinal ends of heating roller 22 so that the temperature of the ends of heating roller 22 can be adjusted.

When heating roller 22 entirely becomes hot, the space must be further increased.

This example employs a structure having shape-memory materials 324 and 326 for such a situation. Specifically, shape-memory materials 324 and 326 are members that change their shape depending on the temperature. At a high temperature, each of shape-memory materials 324 and 326 in this example takes the shape to function as the spring applying the biasing force. At a low temperature, these are extended by the biasing force applied from the elastic members. Owing to provision of shape-memory materials 324 and 326 having the above properties, the biasing force of the elastic members press heat-insulating rotation roller unit 312 against heat-insulating rotation roller 46 when the temperature is low. When the temperature is high, the springs formed of the shape-memory materials overcome the biasing force of the elastic members to separate heat-insulating rotation roller unit 312 from heat-insulating rotation roller 46.

Figure 13:
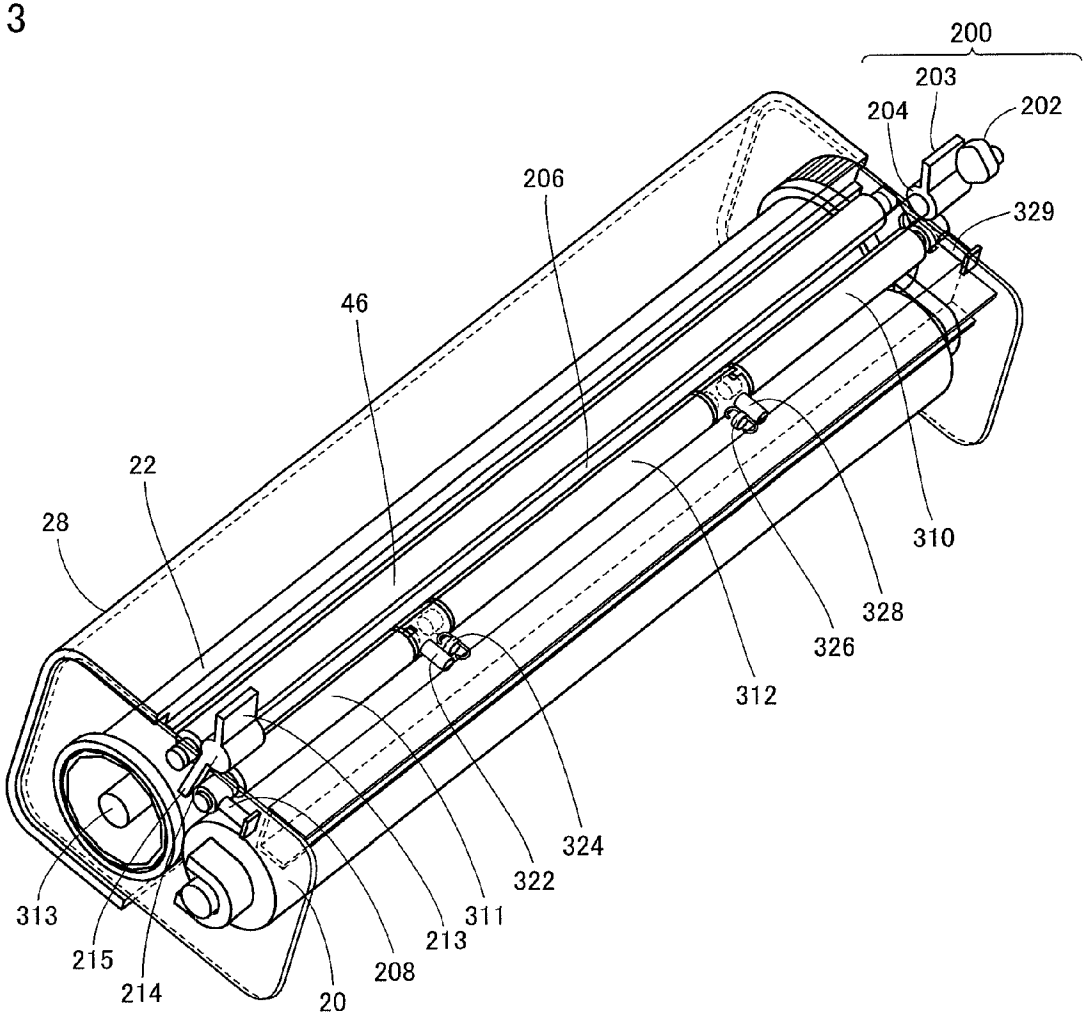
FIG. 13 is a perspective view showing still another state of the fixing device provided with the separating unit according to the second embodiment of the invention.

Referring to FIG. 13, description will be given with respect to a perspective view showing further another state of fixing device 210 provided with separating unit 200 according to the second embodiment of the invention.

Referring to FIG. 13, there is shown a case in which the temperature further rises, and shape-memory materials 324 and 326 exhibiting the biasing force as the springs are further shrunk.

In this state, these materials function as the springs to apply the biasing force separating heat-insulating rotation roller unit 312 from heat-insulating rotation roller 46. Since the space increases, the temperature of heating roller 22 can be further adjusted.

Figure 14:
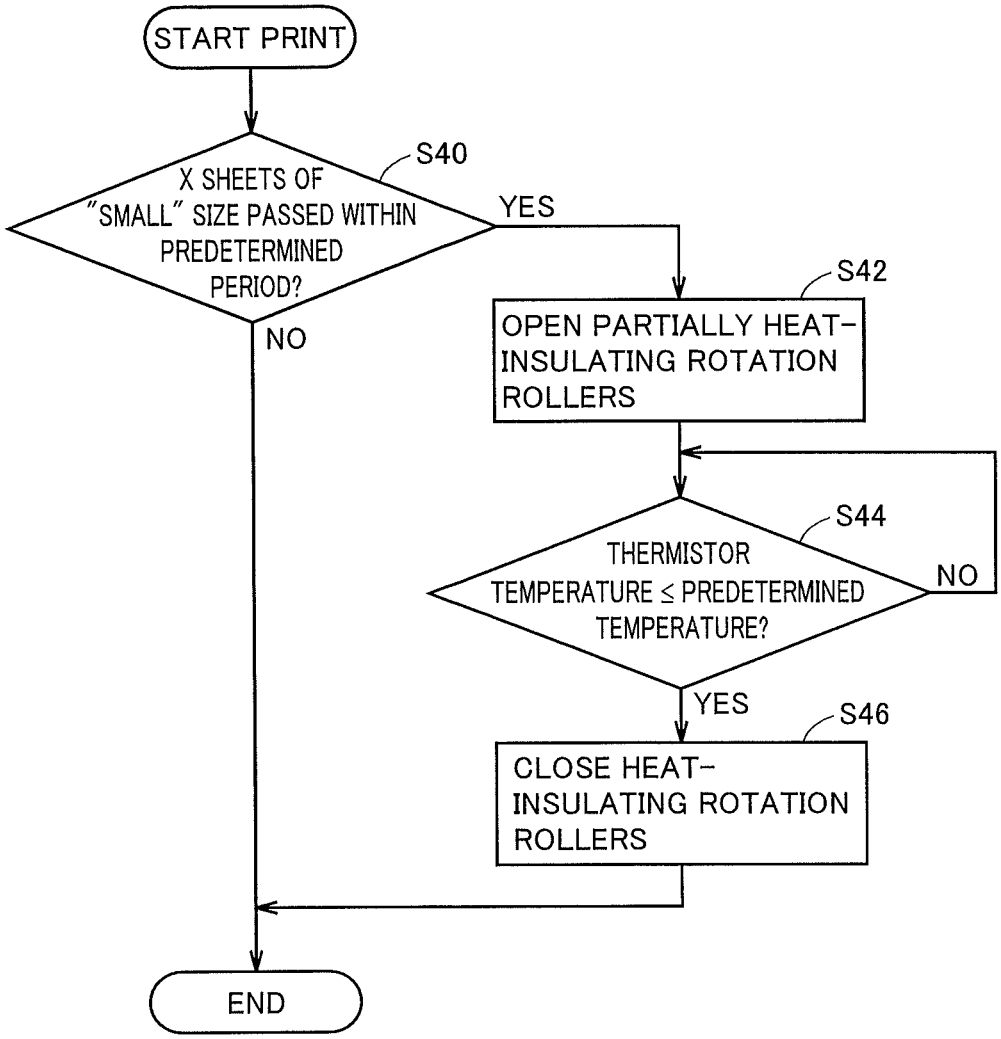
FIG. 14 is a flowchart illustrating a drive sequence of the separating unit according to the second embodiment of the invention.

Referring to FIG. 14, description will be given on a drive sequence of the separating unit according to the second embodiment of the invention.

The drive sequence is implemented by controller 10 reading a software program stored in memory 12.

Referring to FIG. 14, controller 10 starts the foregoing print operation according to the print start instruction. It determines whether the recording paper sheets that are "small" in size and X or more in number were fed within a predetermined period or not (step S40).

When it is determined in step S40 that the recording paper sheets of "small" in size and X or more in number were not fed within the predetermined period (NO in step S40), the processing ends (END). Thus, it is determined that the end of heating roller 22 is not yet hot, and does not operate the separating unit.

When it is determined in step S40 that the recording paper sheets of "small" in size and X or more in number were fed within the predetermined period (YES in step S40), controller 10 partially opens the heat-insulating rotation rollers (step S42). Specifically, controller 10 instructs the gear and motor (not shown) to locate rotation pressing member 202 at the predetermined angle. Thus, rotation pressing member 202 presses contact piece 203 to rotate the rotation member arranged on the end of rotation shaft 206. According to the rotation of the rotation member, it presses the bearing member of heat-insulating rotation roller unit 310 in contact with pressing piece 205, against the biasing force of elastic member 329, to separate heat-insulating rotation roller unit 310 from heat-insulating rotation roller 46 so that a space is formed between heat-insulating rotation roller 46 and heat-insulating rotation roller unit 310. The other rotation member on the end connected to rotation shaft 206 rotates. Thus, according to the rotation of another rotation member, it presses the bearing member of heat-insulating rotation roller unit 311 in contact with pressing piece 215, against the biasing force of elastic member 208, to separate heat-insulating rotation roller unit 311 from heat-insulating rotation roller 46 so that a space is formed between heat-insulating rotation roller 46 and heat-insulating rotation roller unit 311.

Thereby, heat-insulating rotation roller units 310 and 311 arranged at the positions corresponding to the longitudinal ends of heating roller 22, respectively, are spaced from heat-insulating rotation roller 46. Thereby, the space is formed so that the temperature of the ends of heating roller 22 is adjusted. Therefore, the print operation can continue without an interruption.

Then, controller 10 determines whether the temperature of thermistor is equal to or lower than the predetermined temperature or not (step S44). When it is determined that the temperature of thermistor is equal to or lower than the predetermined temperature (YES in step S44), the heat-insulating rotation rollers are closed (step S46). The closing of the heat-insulating rotation rollers is performed as already described, and description thereof is not repeated.

When it is determined that the temperature of thermistor exceeded the predetermined temperature (NO in step S44), the current state is maintained. Thus, the open state is maintained.

Therefore, when the temperature of the end of heating roller 22 is equal to or lower than the predetermined temperature, closing portion 45 closes the exit port so that the temperature of fixing device 110 can be finely adjusted, and the thermal energy can be efficiently used.

This example has been described in connection with the case in which heat-insulating rotation roller unit 312 and heat-insulating rotation roller 46 are separated from each other or are pressed together according to the changes in shape of the shape-memory materials depending on the temperature. However, this is not restrictive, and mechanical control may be employed to perform the separation and pressing similarly to other heat-insulating rotation roller units 311 and 310.

This example has been described in connection with the system that employs separating unit 200 for separating heat-insulating rotation roller 46 and heat-insulating rotation roller units 311 and 310 when the temperature of the end of heating roller 22 is high. However, the system may be likewise configured to separate heat-insulating rotation roller 46 therefrom, e.g., when the temperature of the central portion thereof is high.

(Third Embodiment)

The foregoing embodiment has been described in connection with the structure that employs separating unit 200 for separating the roller from heat-insulating rotation roller 46 or forming the nip region with respect to heat-insulating rotation roller 46 for pressing. However, such a configuration may be employed that separates the roller from heat-insulating rotation roller 46 or forms the nip region with respect to heat-insulating rotation roller 46 for pressing without employing separating unit 200.

Figure 15:
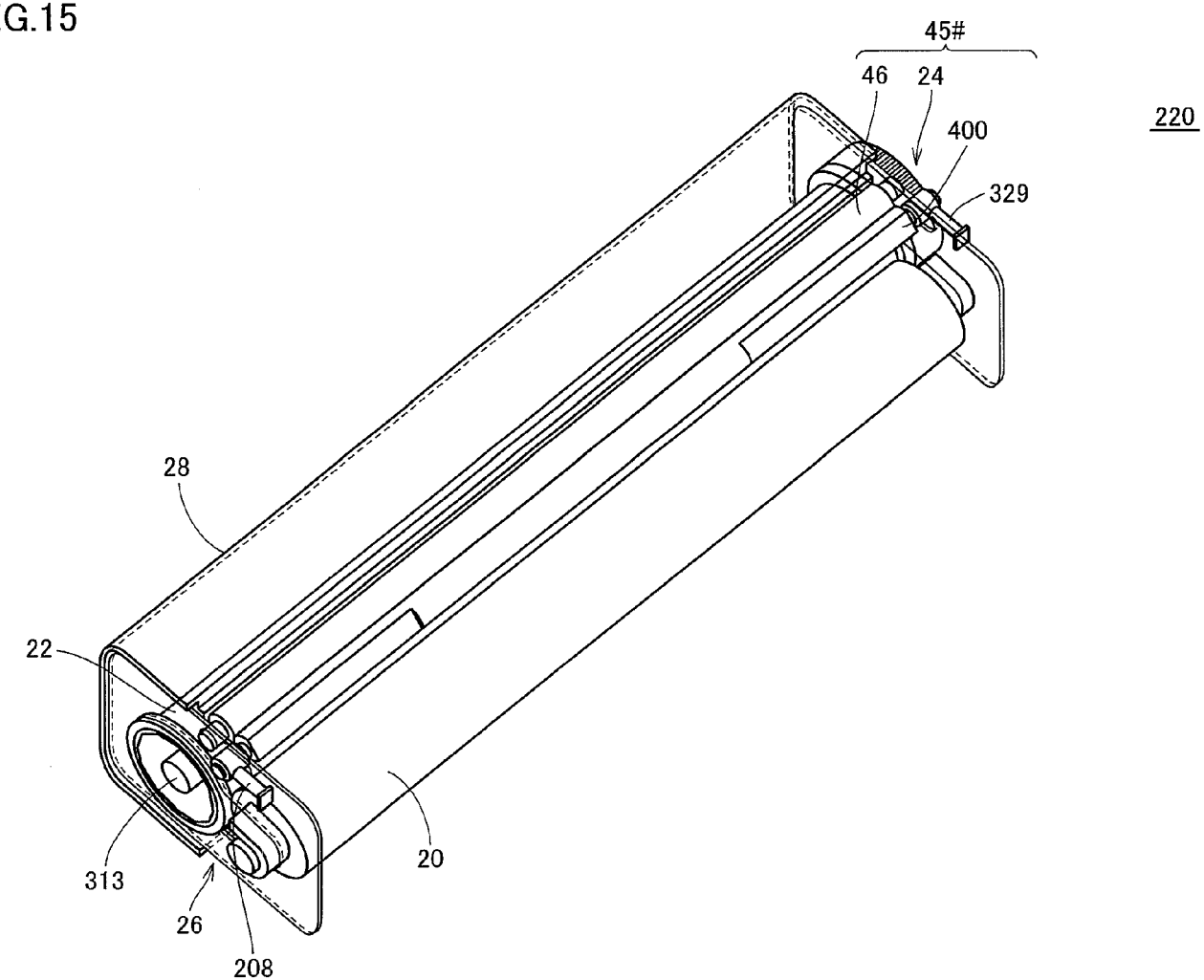
FIG. 15 is a perspective view of a fixing device according to a third embodiment of the invention.

Referring to FIG. 15, description will be given with respect to a perspective view of a fixing device 220 according to a third embodiment of the invention.

Referring to FIG. 15, fixing device 220 according to the third embodiment of the invention is provided with exit port 24 that is located on an upper side (downstream side in the transporting direction of the recording paper sheet) of casing 28, and is also provided with entry port 26 that is located on the opposite, i.e., lower side (upstream side in the transporting direction of the recording paper sheet).

Casing 28 is provided with heating roller 22 containing halogen lamp 313 as well as pressing roller 20.

The recording paper sheet transported through entry port 26 on the lower side of casing 28 is subjected to the heating and pressing by heating and pressing rollers 22 and 20 for fixing the toner image, and then is discharged through exit port 24.

The third embodiment of the invention employs a closing portion 45# for closing an exit port 24.

Specifically, closing portion 45# includes heat-insulating rotation rollers 46 and 400. Although heat insulators 44 and 50 are not employed, these may be employed. Heat-insulating rotation rollers 46 and 400 are pressed together to form a nip region. This nip region is formed to form a space in only a region of the recording paper sheet during passing of the recording paper sheet.

Heat-insulating rotation roller 46 rotates to discharge through exit port 24 the recording paper sheet onto which the toner image was fixed by heating and pressing rollers 22 and 20.

In this structure, elastic members 208 and 329 are arranged between the bearing member of heat-insulating rotation roller 400 and casing 28. On one side, elastic members 208 and 329 are coupled to casing 28 and, on the other side, are coupled to heat-insulating rotation roller 400 for pressing it against heat-insulating rotation roller 46. The elastic members may be elastic rubber, elastic springs and the like.

Since heat-insulating rotation rollers 46 and 400 form the nip region, it is possible to suppress the external releasing of the heat through the exit port when the recording paper sheet is discharged.

Figure 16:
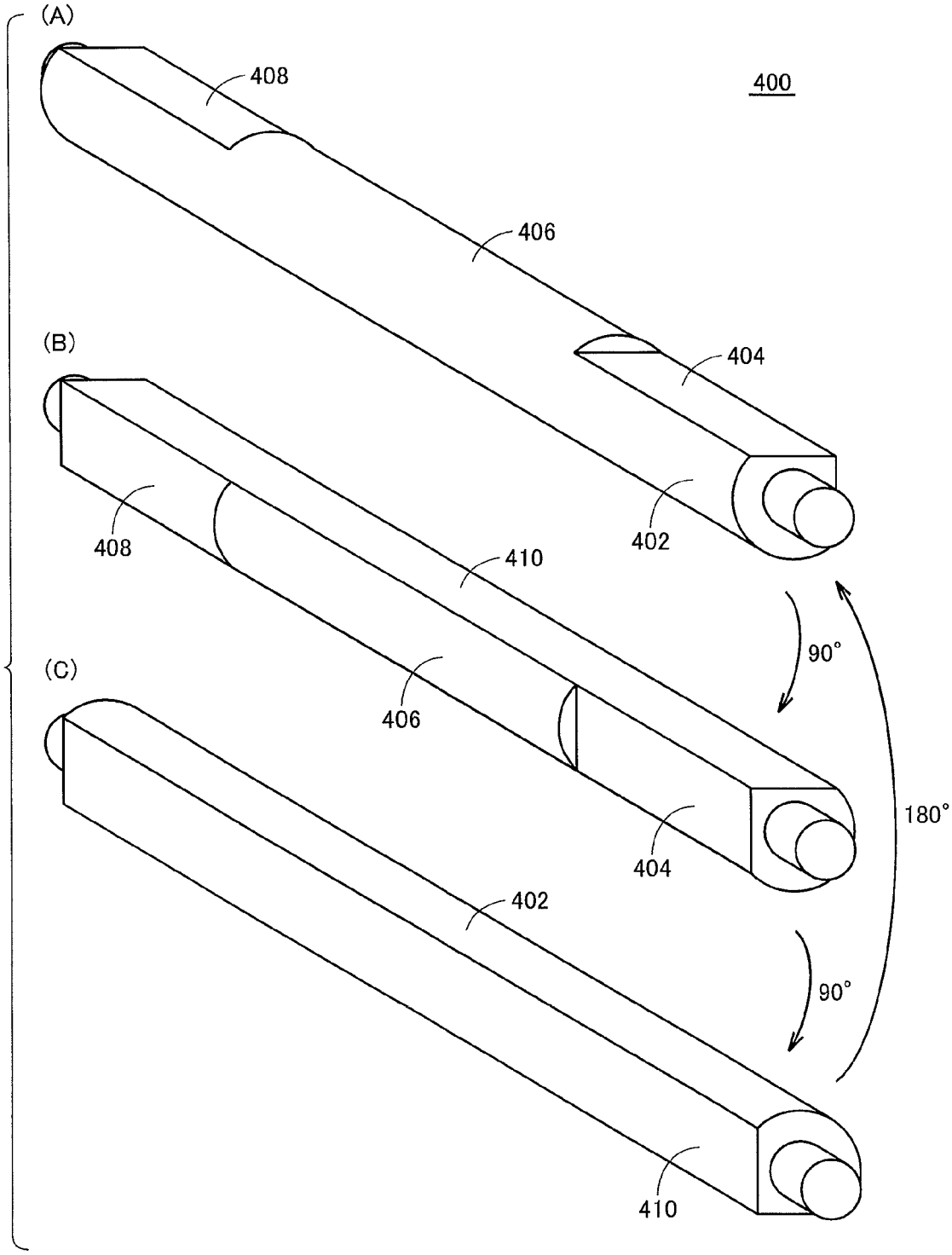
FIG. 16 illustrates a structure of a heat-insulating rotation roller according to the third embodiment of the invention.

Referring to FIG. 16, description will be given on a structure of heat-insulating rotation roller 400 according to the third embodiment of the invention.

Referring to FIG. 16, heat-insulating rotation roller 400 according to the third embodiment of the invention can assume three states in connection with the rotation angle. The rotation angle of heat-insulating rotation roller 400 is set to a predetermined value by the gear and motor (not shown) according to the instruction of controller 10.

Specifically, heat-insulating rotation roller 400 has three regions of different shapes in the circumferential direction.

Referring to FIG. 16(A), in an initial state (first state), the central portion and the end portions of heat-insulating rotation roller 400 have arc-shape forms, and have circular cylindrical forms to form the nip region throughout the longitudinal length of heat-insulating rotation roller 46.

Referring to FIG. 16(B), as a second region in the case (second state) in which the roller has rotated 90 degrees from the initial state, heat-insulating rotation roller 400 has a convex portion at its central area, and has a circular cylindrical form to form the nip region by the convex portion and heat-insulating rotation roller 46. The ends have retracted portions (flat portions) 404 and 408 formed by recessing the circular cylindrical form. Retracted portions 404 and 408 form spaces with respect to longitudinally spaced portions of heat-insulating rotation roller 46.

Referring to FIG. 16(C), as a third region in the case (third state) where the roller has rotated 180 degrees from the initial state, heat-insulating rotation roller 400 has a retracted portion (flat portion) 410 by recessing all the central portion and end portions of the circular cylindrical portion. Retracted portion 410 forms a space with respect to heat-insulating rotation roller 46 throughout its longitudinal length.

By rotating the roller by 180 degrees from the above state, it assumes the initial state in FIG. 16(A).

In the third embodiment of the invention, the rotation angle of heat-insulating rotation roller 400 is controlled to control the closed and separated states with respect to heat-insulating rotation roller 46.

Figure 17:
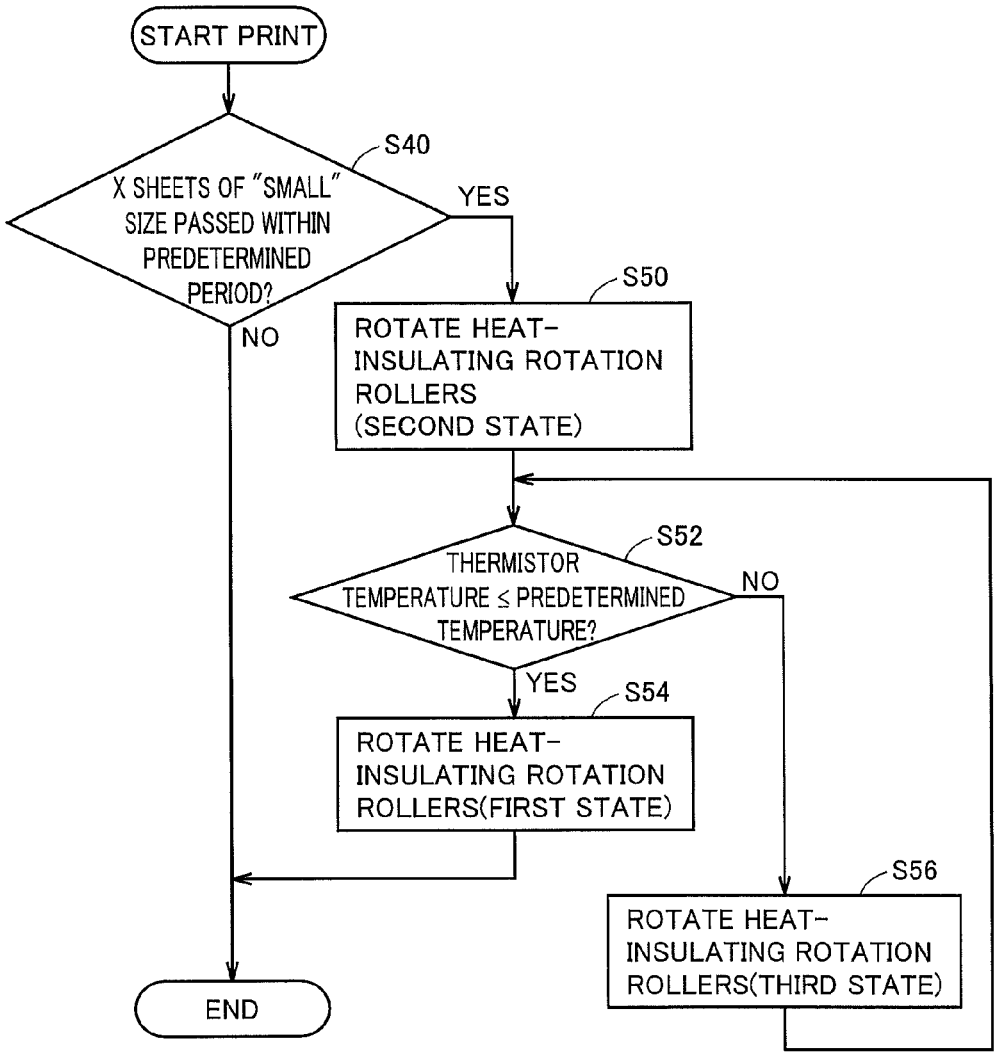
FIG. 17 is a flowchart illustrating a drive sequence of the heat-insulating rotation roller according to the third embodiment of the invention.

Referring to FIG. 17, description will be given on the drive sequence of the heat-insulating rotation roller according to the third embodiment of the invention.

This drive sequence is implemented by controller 10 reading a software program stored in memory 12.

Referring to FIG. 17, controller 10 starts the above print operation according to the print start instruction. It determines whether the recording paper sheets that are "small" in size and X or more in number were fed within a predetermined period or not (step S40).

When it is determined in step S40 that the recording paper sheets of "small" in size and X or more in number were not fed within the predetermined period (NO in step S40), the processing ends (END). Thus, it is determined that the end of heating roller 22 has not yet reached a high temperature, and heat-insulating rotation roller 400 is not rotated.

When it is determined that the recording paper sheets of "small" in size and X or more in number were fed within the predetermined period (YES in step S40), controller 10 partially rotates the heat-insulating rotation roller (step S50). Specifically, controller 10 instructs the gear and motor (not shown) so that the rotation angle of heat-insulating rotation roller 400 attains the second state in FIG. 16(B). In this second state, the ends of heat-insulating rotation roller 400 having retracted portions 404 and 408 formed by recessing the circular cylindrical form produce a space with respect to heat-insulating rotation roller 46.

Thereby, similarly to the manner described in connection with the second embodiment, heat-insulating rotation roller units 310 and 311 corresponding to the longitudinal ends of heating roller 22 are spaced from heat-insulating rotation roller 46 so that the spaces are formed and the temperature of the ends of heating roller 22 is adjusted.

Then, controller 10 determines whether the temperature of thermistor is equal to or lower than the predetermined temperature or not (step S52). When it is determined that the temperature of thermistor is equal to or lower than the predetermined temperature (YES in step S52), the heat-insulating rotation roller rotates (step S54). Specifically, heat-insulating rotation roller 400 rotates to attain the rotation angle in the initial state (first state) in FIG. 16(A). Specifically, the rotation angle of heat-insulating rotation roller 400 is set to attain the initial state in FIG. 16(A). In this state, heat-insulating rotation roller 400 exhibits the circular cylindrical form in the circumferential direction to form the nip region with respect to heat-insulating rotation roller 46. Therefore, the closed state is attained.

Conversely, when it is determined that the temperature of the thermistor exceeds the predetermined value (NO in step S52), controller 10 rotates the heat-insulating rotation roller (step S56).

Specifically, the rotation angle of heat-insulating rotation roller 400 is set to the third state in FIG. 16(C). In this third state, heat-insulating rotation roller 400 entirely having retracted portion 410 prepared by recessing the circular cylindrical form produces a space between the recessed portion and heat-insulating rotation roller 46. Thereby, in the region corresponding to the longitudinally whole area of heating roller 22, the space is formed between retracted portion 410 and heat-insulating rotation roller 46 so that the temperature of the whole surface of heating roller 22 is adjusted.

(Fourth Embodiment)

In a fourth embodiment, description will be given on drive systems of heating roller 22 and heat-insulating rotation roller 46.

Figure 18:
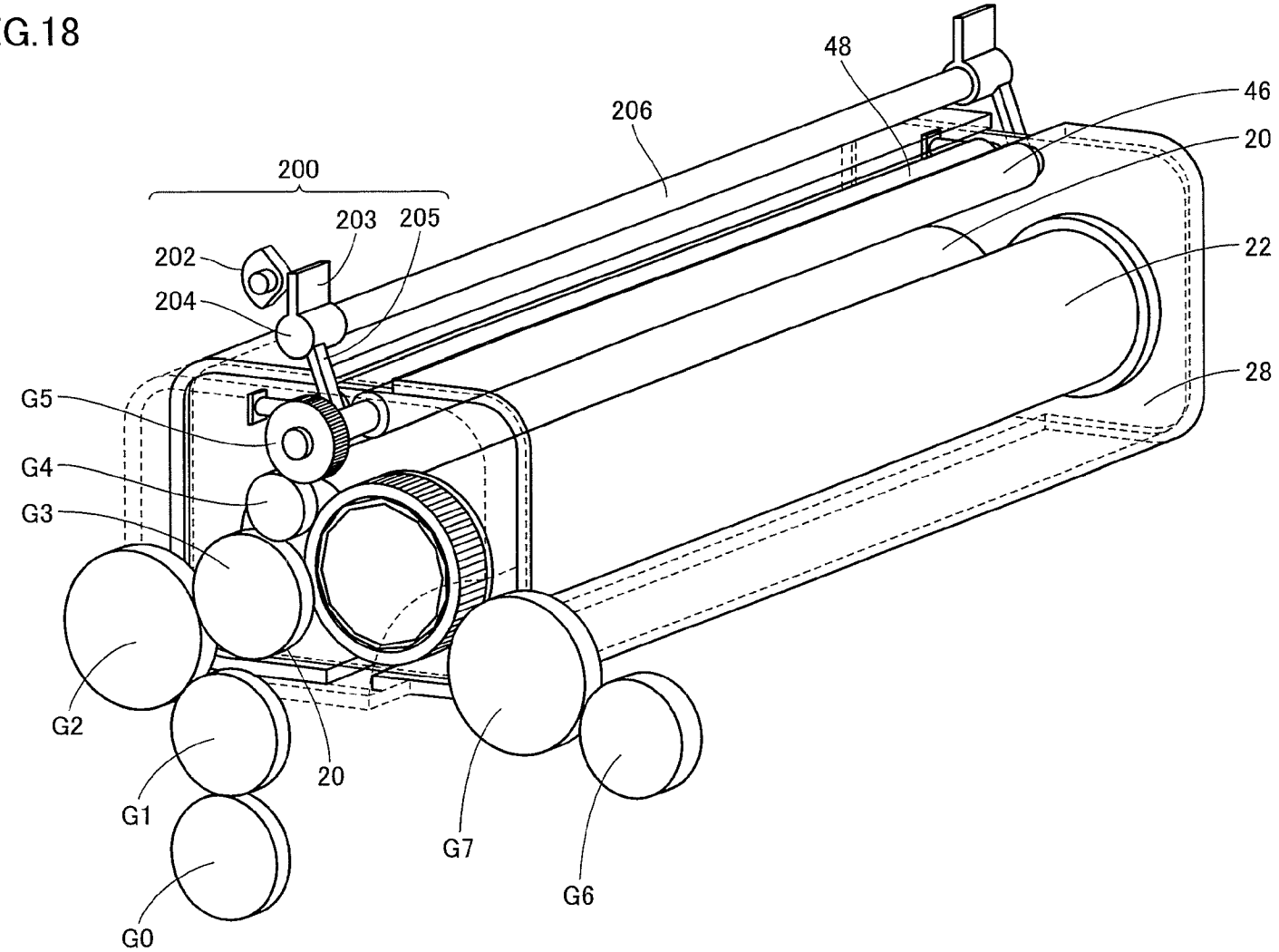
FIG. 18 illustrates respective drive systems of a heating roller and a heat-insulating rotation roller according to a fourth embodiment of the invention.

Referring to FIG. 18, description will be given on the respective drive systems of heating roller 22 and heat-insulating rotation roller 46 according to the fourth embodiment of the invention.

Referring to FIG. 18, there is shown a case in which a plurality of gears G0-G5 driving heat-insulating rotation roller 46 as well as a plurality of gears G6 and G7 driving heating roller 22 are arranged.

Neighboring gears G0-G5 are coupled together to transmit the drive of gear G0 for rotating gear G5. Gear G5 is coupled to the rotation shaft of heat-insulating rotation roller 46. Thus, heat-insulating rotation roller 46 rotates according to the rotation direction of gear G5. Heat-insulating rotation roller 48 is driven to rotate according to the rotation of heat-insulating rotation roller 46.

Figure 19B:
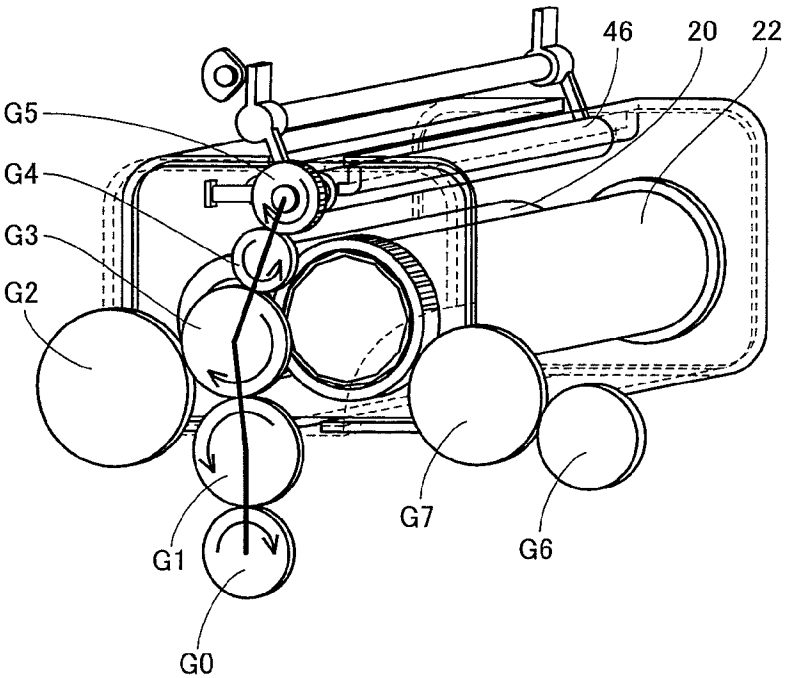
FIGS. 19A and 19B are views illustrating a rotation direction of heat-insulating rotation roller.
Figure 19A:
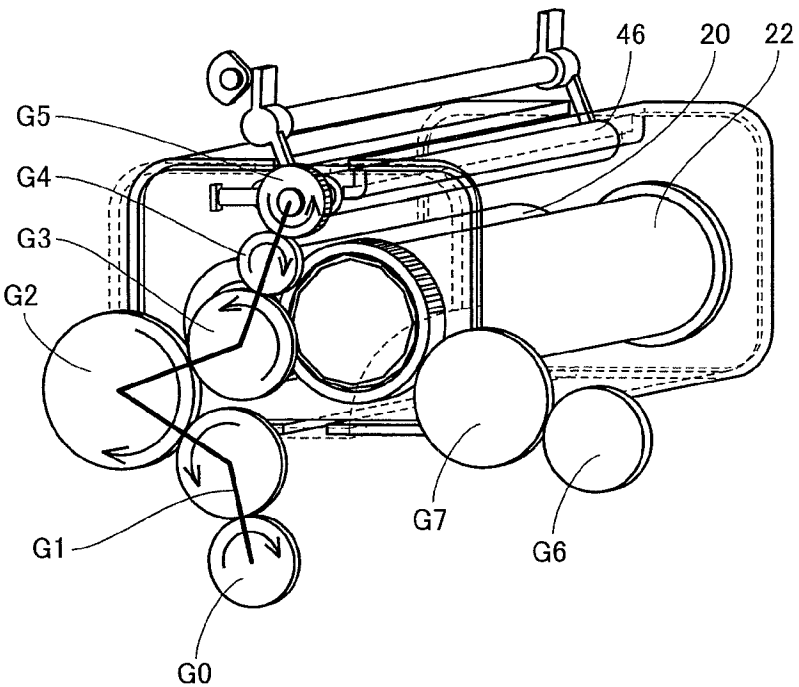

Referring to FIGS. 19A and 19B, description will be given on the rotation direction of heat-insulating rotation roller 46.

FIG. 19A shows the case in which heat-insulating rotation rollers 46 and 48 rotate such that the recording paper sheet passed between heat-insulating rotation rollers 46 and 48 is externally discharged from fixing device 110.

Heating roller 22 is driven to rotate by gear G6. Pressing roller 20 is driven by heating roller 22.

When the motor (not shown) rotates according to the instruction of controller 10, gear G0 coupled thereto rotates.

Referring to FIG. 19B, gear G1 occupies a position adjusted by a lever (not shown). Specifically, gear G1 is located between gears G0 and G3, and are coupled thereto. Therefore, the drive of gear G0 is successively transmitted through gears G1, G3 and G4 to gear G5. In this structure, the number of the gears that are coupled together without using gear G2 is adjusted, and thereby the rotation direction is inverted. Thus, as shown in FIG. 19B, heat-insulating rotation roller 46 in FIG. 19A rotates in the reverse direction.

The motor not shown rotates according to the instruction of controller 10 so that gear G0 coupled thereto rotates, and the lever (not shown) adjusts the position of gear G1 according to the instruction of controller 10.

By changing the path for transmitting the drive by the above structure, it is possible to control the rotation direction of heat-insulating rotation roller 46.

When the recording paper sheet is transported according to the above structure, heat-insulating rotation roller 46 can rotate as shown in FIG. 19A to assist the external transportation from fixing device 110. By changing the rotation direction of heat-insulating rotation roller 46, it is possible to supply the external air into fixing device 110 by reversely rotating heat-insulating rotation roller 46 as shown in FIG. 19B so that the rising of the inner temperature in fixing device 110 can be suppressed when the inside temperature of fixing device 110 may rise excessively.

Therefore, when the above embodiment is employed for combination, the exit port can be set to the open state and heat-insulating rotation roller 46 can be rotated reversely so that the external air can be supplied into fixing device 110 more efficiently.

(First Modification of the Fourth Embodiment)

Figure 20:
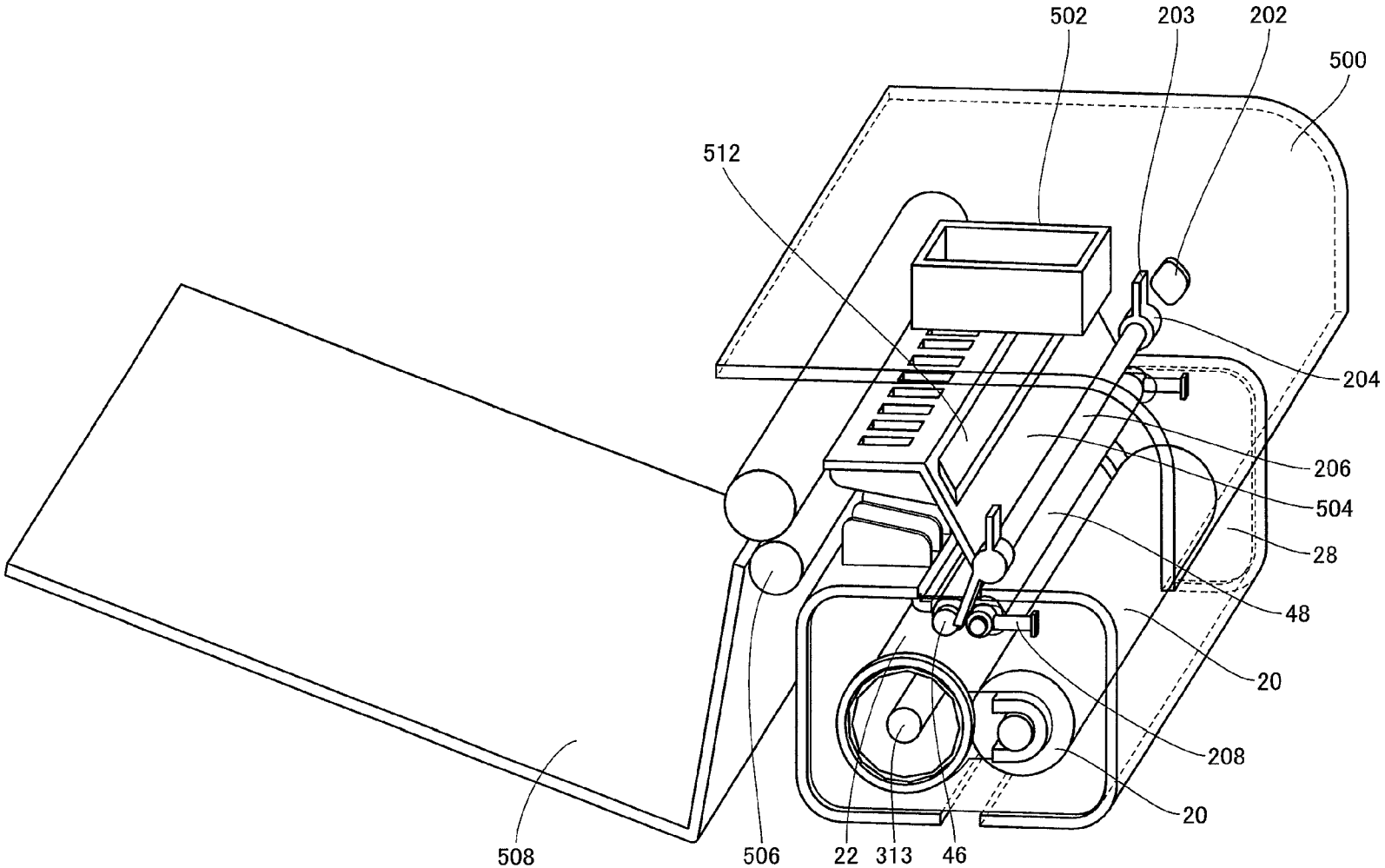
FIG. 20 is a perspective view of an upper structure of a fixing device according to a first modification of the fourth embodiment of the invention.

Referring to FIG. 20, description will be given with respect to a perspective view of an upper structure of fixing device 110 according to a first modification of the fourth embodiment of the invention.

Referring to FIG. 20, there is shown a cover 500 in an upper portion of the casing. A fan 502 is arranged inside cover 500 in the upper portion of the casing. Fixing device 110 is provided at its upper portion with a discharge guide 504 for guiding the recording paper sheet to a discharge roller 506. The recording paper sheet discharged from fixing device 110 is guided by discharge guide 504 to discharge roller 506, which discharges the recording paper sheet to a discharge tray 508 outside image forming apparatus 100. In this example, discharge guide 504 is provided with an openable shutter unit 512. In this example, shutter unit 512 is closed.

Figure 21:
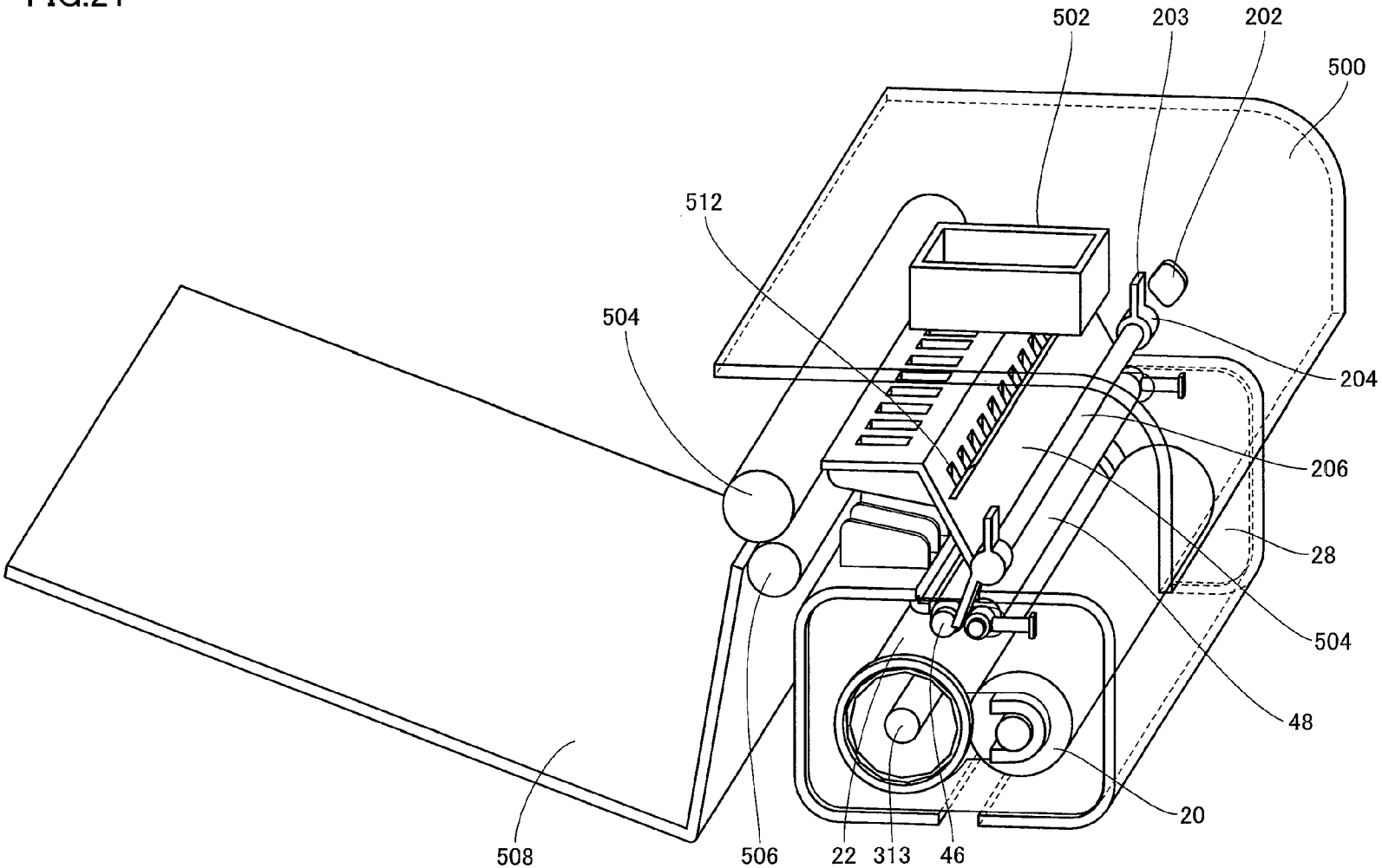
FIG. 21 is another perspective view of the upper structure of the fixing device according to the first modification of the fourth embodiment of the invention.

Referring to FIG. 21, description will be given on another perspective view of an upper structure of fixing device 110 according to the first modification of the fourth embodiment of the invention.

Referring to FIG. 21, shutter unit 512 of discharge guide 504 is open in contrast to the structure in FIG. 20.

According to the first modification of the fourth embodiment of the invention, fan 502 is driven to supply an air to fixing device 110 when shutter unit 512 of discharge guide 504 is open.

When the internal temperature of fixing device 110 is excessively high, shutter unit 512 in the above structure opens, e.g., as shown in FIG. 21, and the fan is driven to supply the external air into fixing device 110 so that the rising of the inside temperature of fixing device 110 can be suppressed.

In the combination with the foregoing embodiment, the exit port of fixing device 110 is kept open and the fan is driven so that the external air can be supplied into fixing device 110 more efficiently.

(Other Structures of the Fixing Device)

The first embodiment has been described in connection with the structure of fixing device 110 illustrated in FIG. 2. However, the structure is not restricted to it, and a fixing device to be described below can likewise be applicable.

FIRST EXAMPLE

Figure 22:
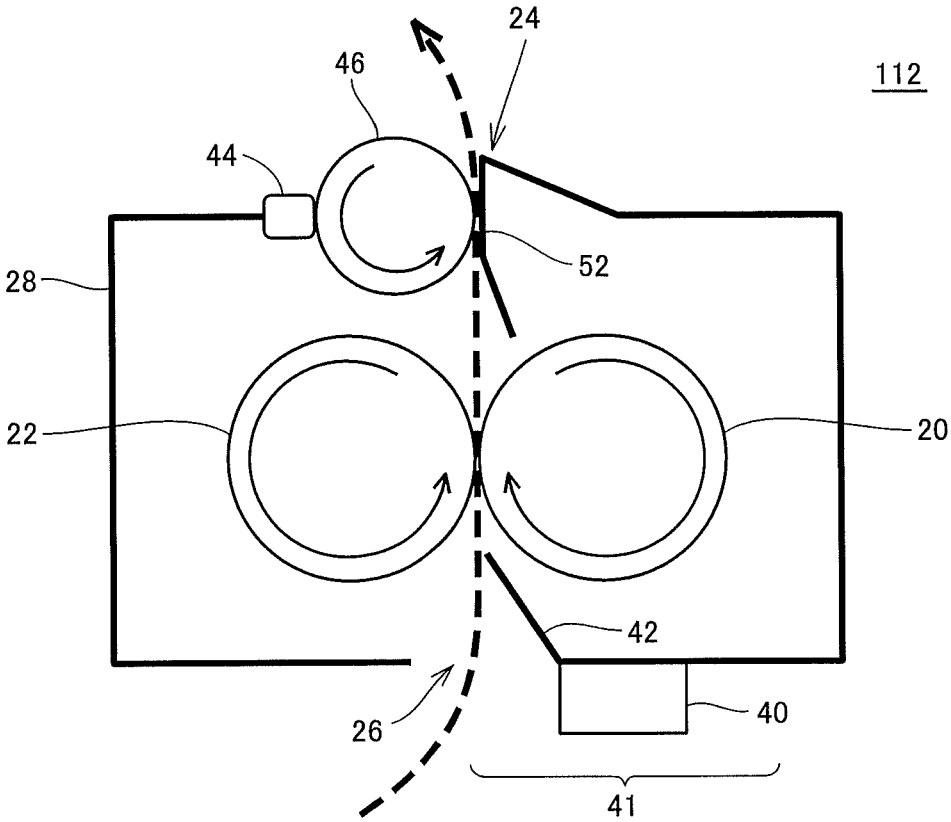
FIG. 22 is a cross section of a fixing device (first example).

Referring to FIG. 22, description will be given on a cross section of a fixing device (first example).

Referring to FIG. 22, a fixing device 112 differs from fixing device 110 illustrated in FIG. 2 in that heat-insulating rotation roller 48 and heat insulator 50 are not arranged, and heat-insulating rotation roller 46 is in direct contact with a partial region 52 of casing 28. Other structures are substantially the same as those shown in FIG. 2, and therefore description thereof is not repeated.

Heat-insulating rotation roller 46 is pressed against partial region 52 of casing 28 to form the nip region. Partial region 52 of casing 28 functions as a guide member externally transporting from casing 28 the recording paper sheet that is transported from heating and pressing rollers 22 and 20.

In the above structure, exit port 24 is likewise closed by partial region 52 of casing 28 and heat-insulating rotation roller 46. In this example, partial region 52 is pressed by separating unit 200 as described before, although not shown. Specifically, it is in contact with pressing piece 215 according to the rotation of cylindrical portion 214. Specifically, it is pressed against partial region 52 to separate it from heat-insulating rotation roller 46 according to the rotation of cylindrical portion 214.

Partial region 52 pressed by the above operation moves away from heat-insulating rotation roller 46. Thereby, the nip region is released to form a space between heat-insulating rotation roller 46 and partial region 52, and this structure can employ the system in the embodiment already described. Since the structure does not employ heat-insulating rotation roller 48 and heat insulator 50 so that the number of parts can be reduced.

SECOND EXAMPLE

Figure 23:
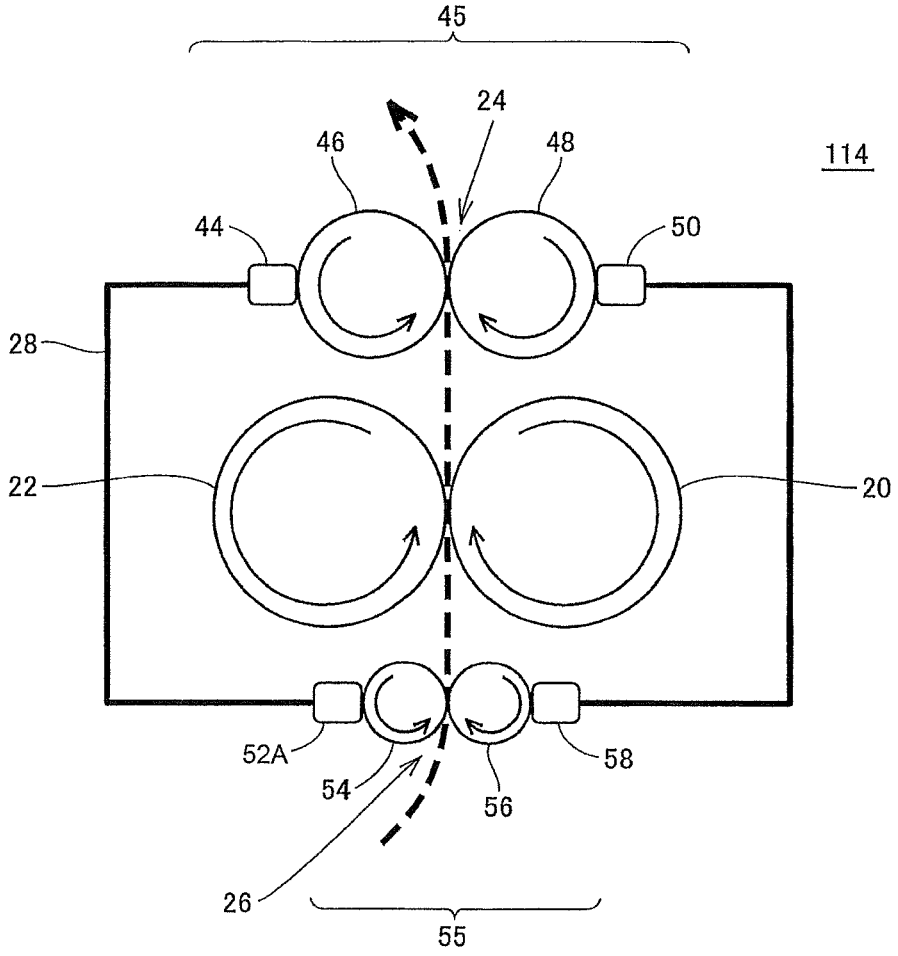
FIG. 23 is a cross section of another fixing device (second example).

Referring to FIG. 23, description will be given on a cross section of a fixing device (second example).

Referring to FIG. 23, a fixing device 114 differs from fixing device 110 illustrated in FIG. 2 in that closing portion 41 is replaced with a closing portion 55.

Closing portion 55 includes heat insulators 52A and 58, and heat-insulating rotation rollers 54 and 56. Heat-insulating rotation rollers 54 and 56 are pressed together to form a nip region. The nip region is formed such that a space is not formed in a region other than the recording paper sheet during passing of the recording paper sheet.

Heat-insulating rotation rollers 54 and 56 rotate to take in the recording paper sheet through entry port 26.

Therefore, heat-insulating rotation rollers 54 and 56 form the nip region, and therefore can eliminate a gap in the entry port to suppress external releasing of the heat when the recording paper sheet is taken in according to the rotation of heat-insulating rotation rollers 54 and 56.

Thereby, the inside temperature of fixing device 110 can be raised further quickly so that the warm-up time can be reduced and the temperature lowering of the heating roller can be restrained. Therefore, the improvement in energy efficiency can achieve energy saving as well as reduction in running cost.

This structure can employ the system in the embodiment already described.

THIRD EXAMPLE

Figure 24:
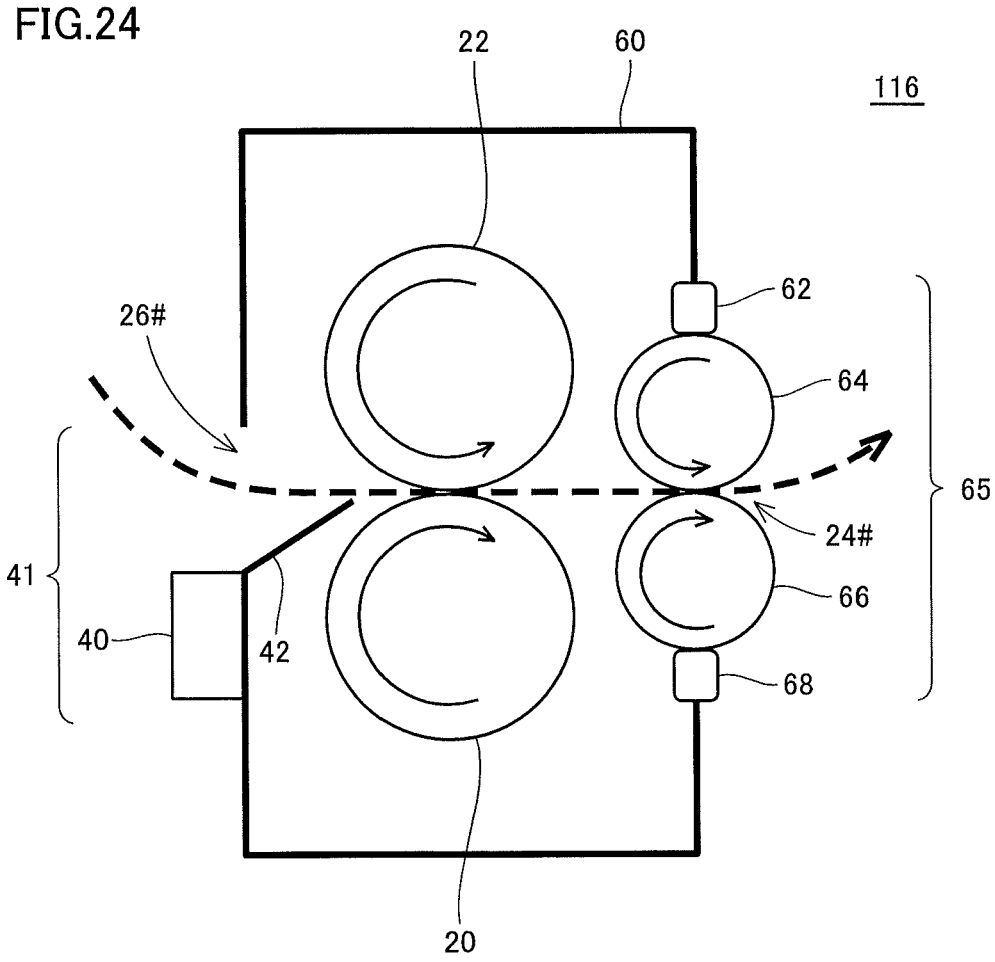
FIG. 24 is a cross section of still another fixing device (third example).

Referring to FIG. 24, description will be given on a cross section of a fixing device (third embodiment).

Referring to FIG. 24, a fixing device 116 is provided with a casing 60, and is also provided with an exit port 24# located on the right side (downstream side in the document transporting direction) of casing 60 as well as an entry port 26# located on the opposite, i.e., the left side (upstream side in the transporting direction of the document).

A closing portion 65 arranged in exit port 24# and closing portion 41 arranged in entry port 26# are also shown.

Closing portion 65 includes heat-insulating rotation rollers 64 and 66 as well as heat insulators 62 and 68, and have substantially the same structure except for the reference numbers as the structure of closing portion 45.

Closing portion 41 is the same as that already described.

Therefore, heat-insulating rotation rollers 64 and 66 form the nip region, and therefore can suppress external releasing of the heat through the exit port when the recording paper sheet is externally transported according to the rotation of heat-insulating rotation rollers 64 and 66.

Although not shown, the fixing device (first example) horizontally transporting the recording paper sheet can likewise employ the above structure This structure can likewise employ the configuration in the foregoing embodiment.

FOURTH EXAMPLE

Figure 25:
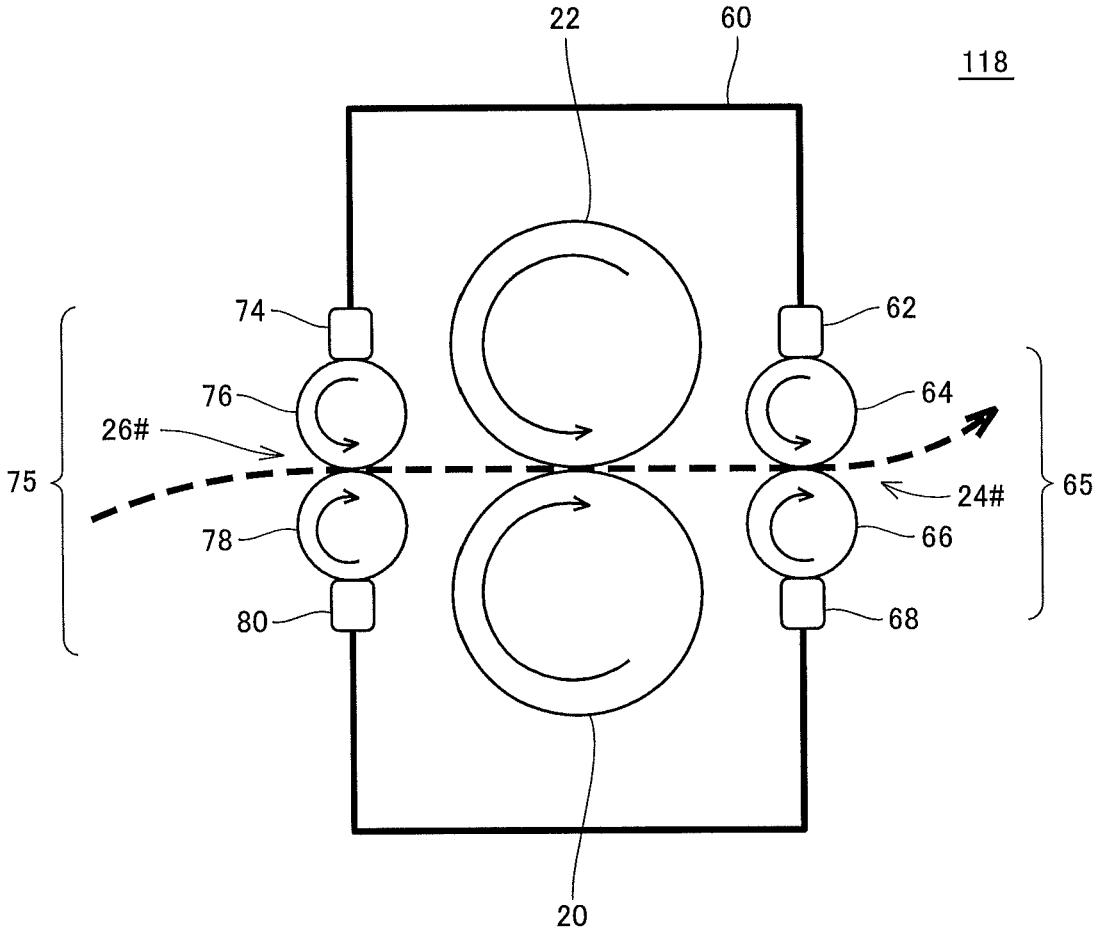
FIG. 25 is a cross section of yet another fixing device (fourth example).

FIG. 25 is a cross section of a fixing device (fourth example).

Referring to FIG. 25, a fixing device 118 differs from fixing device 116 in FIG. 24 in that it is provided at entry port 26# with a closing portion 75 in place of closing portion 41.

Closing portion 75 includes heat-insulators 74 and 80 as well as heat-insulating rotation rollers 76 and 78. Heat-insulating rotation rollers 76 and 78 are pressed together to form a nip region. The nip region is formed such that a gap is not formed in a region other than the recording paper sheet when the recording paper sheet is passing.

Heat-insulating rotation rollers 76 and 78 rotate to transport the recording paper sheet through entry port 26#.

Since heat-insulating rotation rollers 76 and 78 form the nip region, these can eliminate the gap in the entry port when the recording paper sheet is taken in according to the rotation of heat-insulating rotation rollers 76 and 78, and therefore can suppress external releasing of the heat.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A fixing device for fixing a toner image onto a recording paper sheet comprising:

a heating member for heating said recording paper sheet;

a pressing member for applying a pressure by forming contact with said heating member;

a casing accommodating said heating member and said pressing member, and provided with an exit port for discharging said recording paper sheet;

a closing portion arranged at said exit port for keeping a temperature of said casing, said closing portion having a rotation member and an opposed member forming a nip region together with said rotation member;

a separating unit for changing at least a part of said closing portion from a closed state to an open state;

said closing portion further includes an elastic member arranged on a side opposed to said rotation member with said opposed member therebetween for biasing said opposed member to press said opposed member against said rotation member, and said separating unit has a pressing member for pressing said opposed member, against a biasing force of said elastic member, in a direction separating said opposed member from said rotation member.

2. The fixing device according to claim 1, wherein said pressing member further has a contact piece being rotatable around a rotation axis and being in contact with said opposed member, and said opposed member is movably arranged to move away from said rotation member in accordance with the rotation of said contact piece around said rotation axis.

3. The fixing device according to claim 1, wherein said opposed member includes a first opposed portion, a second opposed portion neighboring to said first opposed portion and a third opposed portion opposed to said first opposed portion with said second opposed portion therebetween, and said pressing member separates at least a part of said second and third opposed portions from said rotation member.

4. The fixing device according to claim 3, wherein said separating unit further has a shape-memory material arranged on the side opposed to said rotation member with said first opposed portion therebetween for pressing said opposed member, against a biasing force of said elastic member, to separate said opposed member from said rotation member in accordance with a change in temperature.

5. A fixing device for fixing a toner image onto a recording paper sheet comprising:

a heating member for heating said recording paper sheet;

a pressing member for applying a pressure by forming contact with said heating member;

a casing accommodating said heating member and said pressing member, and provided with an exit port for discharging said recording paper sheet;

a closing portion arranged at said exit port for keeping a temperature of said casing, said closing portion having a rotation member and an opposed member forming a nip region together with said rotation member;

a separating unit for changing at least a part of said closing portion from a closed state to an open state;

a rotation drive unit for rotating said rotation member;

a rotation direction of said rotation member is switchable, and said rotation drive unit changes the rotation direction of said rotation member.

6. A fixing device for fixing a toner image onto a recording paper sheet comprising:

a heating member for heating said recording paper sheet;

a pressing member for applying a pressure by forming contact with said heating member;

a casing accommodating said heating member and said pressing member, and provided with an exit port for discharging said recording paper sheet;

a closing portion arranged at said exit port for keeping a temperature of said casing, said closing portion having a rotation member and an opposed member forming a nip region together with said rotation member;

a separating unit for changing at least a part of said closing portion from a closed state to an open state;

said separating unit changes a state of at least a part of said closing portion from the closed state to the open state according to a weight or a size of said recording paper sheet.

7. A fixing device for fixing a toner image onto a recording paper sheet comprising:

a heating member for heating said recording paper sheet;

a pressing member for applying a pressure by forming contact with said heating member;

a casing accommodating said heating member and said pressing member, and provided with an exit port for discharging said recording paper sheet;

a closing portion arranged at said exit port for keeping a temperature of said casing, said closing portion having a rotation member and an opposed member forming a nip region together with said rotation member;

a separating unit for changing at least a part of said closing portion from a closed state to an open state; and said separating unit changes a state of at least a part of said closing portion from the closed state to the open state according to coverage information of contents to be printed on said recording paper sheet.

8. An image forming apparatus comprising:

a fixing device for fixing a toner image onto a recording paper sheet, wherein said fixing device includes:

a heating member for heating said recording paper sheet;

a pressing member for applying a pressure by forming contact with said heating member;

a casing accommodating said heating member and said pressing member, and provided with an exit port for discharging said recording paper sheet;

a closing portion arranged at said exit port for keeping a temperature of said casing, said closing portion having a rotation member and an opposed member forming a nip region together with said rotation member; and a separating unit for changing at least a part of said closing portion from a closed state to an open state said closing portion further includes an elastic member arranged on a side opposed to said opposed member with said rotation member therebetween for biasing said opposed member to press said opposed member against said rotation member, and said separating unit has a pressing member for pressing said opposed member, against a biasing force of said elastic member, in a direction separating said opposed member from said rotation member.

9. A fixing device for fixing a toner image onto a recording paper sheet, comprising:

a heating member for heating said recording paper sheet;

a pressing member for applying a pressure by forming contact with said heating member;

a casing accommodating said heating member and said pressing member, and provided with an exit port for discharging said recording paper sheet; and a closing portion arranged at said exit port for keeping a temperature of said casing, wherein said closing portion has:

a rotation member for discharging said recording paper sheet, and an opposed member forming a nip region together with said rotation member, said opposed member has first, second and third regions in a circumferential surface direction, said first region has an arc-shaped form, and forms a nip region along an entire length in a lengthwise direction of said rotation member, said second region is provided with a partial arc-shape portion for forming a nip region along a partial length in the lengthwise direction of said rotation member, having a first retracted portion for avoiding contact with said rotation member other than said partial arc-shape portion, and said third region is provided with a second retracted portion avoiding contact with said rotation member along an entire length in a lengthwise direction of said rotation member.

* * * * *